US009494966B2

(12) United States Patent
Asano

(10) Patent No.: US 9,494,966 B2
(45) Date of Patent: Nov. 15, 2016

(54) MULTIDIRECTIONAL INPUT DEVICE

(71) Applicant: HOSIDEN CORPORATION, Yao-shi (JP)

(72) Inventor: Mitsuhiro Asano, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 14/576,427

(22) Filed: Dec. 19, 2014

(65) Prior Publication Data

US 2015/0198964 A1 Jul. 16, 2015

(30) Foreign Application Priority Data

Jan. 16, 2014 (JP) ..... 2014-5940

(51) Int. Cl.
*G05G 9/047* (2006.01)
*G05G 5/05* (2006.01)

(52) U.S. Cl.
CPC ..... *G05G 9/047* (2013.01); *G05G 5/05* (2013.01); *G05G 2009/04744* (2013.01); *G05G 2009/04751* (2013.01); *G05G 2009/04777* (2013.01); *Y10T 74/20201* (2015.01)

(58) Field of Classification Search
CPC ..... G05G 9/047; G05G 5/05; G05G 2009/04744; G05G 2009/0475; G05G 2009/04777
USPC ..... 74/471 XY, 473; 200/6 A; 338/128; 345/161
See application file for complete search history.

(56) References Cited

U.S. PATENT DOCUMENTS 3,308,675 A * 3/1967 Jonsson ..... F41A 27/06 200/6 A
3,394,611 A * 7/1968 Beurrier ..... G05G 5/05 338/128
3,550,466 A * 12/1970 Ham ..... E21B 19/14 200/6 A
3,701,963 A * 10/1972 Kasazima ..... G01V 1/09 338/128
3,870,161 A * 3/1975 Cording ..... B66C 13/56 212/228
3,942,148 A * 3/1976 Nishioka ..... G05G 9/047 200/6 A
4,489,304 A * 12/1984 Hayes ..... G05G 9/047 338/128
4,587,510 A * 5/1986 Kim ..... G05G 9/047 338/128
7,019,732 B2 * 3/2006 Furukawa ..... G05G 9/047 345/161
7,320,263 B2 * 1/2008 Gustafsson ..... G05G 5/28 74/471 XY (Continued)

FOREIGN PATENT DOCUMENTS

JP 2001-75727 A1 3/2001

*Primary Examiner* — William Kelleher
*Assistant Examiner* — Zakaria Elahmadi
(74) *Attorney, Agent, or Firm* — Kratz, Quintos & Hanson, LLP

(57) ABSTRACT

A multidirectional input device includes a mount, an operation lever, first and second interlocking members, and first and second detectors. The mount includes a support face of generally spherical convex shape. The operation lever is slidably supported on the support face. The first interlocking member receives the operation lever therethrough and is movable in a first direction in an arc-like manner in accordance with movement in the first direction of the operation lever. The second interlocking member crosses the first interlocking member, receives the operation lever therethrough, and is movable in a second direction in an arc-like manner in accordance with movement in the second direction of the operation lever, the second direction crossing the first direction. The first detector can detect a direction and an amount of movement of the first interlocking member. The second detector can detect a direction and an amount of movement of the second interlocking member.

20 Claims, 9 Drawing Sheets

(56) References Cited

U.S. PATENT DOCUMENTS

| | | | | |
|---|---|---|---|---|
| 7,429,977 | B2 * | 9/2008 | Edmunds | G05G 9/047 345/161 |
| 2003/0019316 | A1 * | 1/2003 | Tews | G05G 9/047 74/471 XY |
| 2005/0217402 | A1 * | 10/2005 | Poulsen | F16H 21/04 74/471 XY |
| 2006/0243080 | A1 * | 11/2006 | Takamoto | G05G 5/05 74/471 XY |
| 2006/0290670 | A1 * | 12/2006 | Ishimaru | G05G 5/05 345/161 |
| 2009/0084214 | A1 * | 4/2009 | Sakai | A43B 21/42 74/471 XY |
| 2011/0048153 | A1 * | 3/2011 | Standke | G05G 5/05 74/471 XY |

* cited by examiner

MULTIDIRECTIONAL INPUT DEVICE

CROSS-REFERENCE TO RELATED APPLICATIONS

The present application claims priority under 35 U.S.C. §119 of Japanese Patent Application No. 2014-5940 filed on Jan. 16, 2014, the disclosure of which is expressly incorporated by reference herein in its entity.

BACKGROUND OF THE INVENTION

1. Technical Field

The invention relates to multidirectional input devices.

2. Background Art

Japanese Patent Application Laid-Open No. 2001-75727 describes a conventional multidirectional input device including a case, an operation lever, first and second rotary members, and first and second detectors. The case has a bottom plate and a boss standing on the bottom plate. The lower end of the operation lever is supported on the boss to allow the operation lever to be tilted. The first and second rotary members are rotatably supported on the case and arranged orthogonal to each other inside the case. The operation lever passes through the first and second rotary members. When the operation lever is tilted, the first and/or second rotary member rotates. The first detector detects the direction and amount of the rotation of the first rotary member. The second detector detects the direction and amount of the rotation of the second rotary member.

SUMMARY OF INVENTION

Generally, this type of multidirectional input devices are installed in portable communication terminals, controllers of game machines, or the like. As portable communication terminals and controllers of game machines are multi-functionalized and downsized, there is a demand for downsized multidirectional input devices.

Downsizing the above conventional multidirectional input device leads to reduced amount of tilt (reduced rotation radius) of the operation lever, making it difficult to provide desirable operational feel. Also, such decreased amount of tilt causes reduction of amounts of rotation (reduction of rotation radius) of the first and second rotary members, making it difficult for the first and second detectors to detect the rotation of the first and second rotary members. Therefore, downsizing the conventional multidirectional input device should results in lower accuracy in detecting operations of the operation lever.

In view of the above circumstances, the invention provides a multidirectional input device including an operation lever that can provide an improved operational feel. The invention can also improve accuracy in detecting operation of the operation lever.

A multidirectional input device according to an aspect of the invention includes a mount, an operation lever, first and second interlocking members, and first and second detectors. The mount includes a support face of generally spherical convex shape. The operation lever is slidably supported on the support face. The first interlocking member is configured to receive the operation lever therethrough and be movable in a first direction in an arc-like manner in accordance with movement in the first direction of the operation lever. The second interlocking member is configured to cross the first interlocking member, receive the operation lever therethrough, and be movable in a second direction in an arc-like manner in accordance with movement in the second direction of the operation lever, the second direction crossing the first direction. The first detector is configured to detect a direction and an amount of movement of the first interlocking member. The second detector is configured to detect a direction and an amount of movement of the second interlocking member.

The multidirectional input device of this aspect has at least the following technical features. First, the device provides an improved operational feel of the operation lever for the following reasons. The operation lever slides on the generally spherically convexed support face of the mount, so that the operation lever can move along a longer route (rotate at a longer radius). Second, the multidirectional input device can detect operations of the operation lever with improved accuracy for the following reason. The first and second interlocking members can move in an arc-like manner in accordance with movement of the operation lever, so that they each can move along a longer route (rotate at a longer radius).

The operation lever may include a support disposed between the first interlocking member and the mount. The first interlocking member may be supported on the support of the operation lever and movable in the first direction in an arc-like manner along the support face of the mount. The first interlocking member may have a support face of arc shape extending in the second direction. The second interlocking member may be slidable in the second direction in an arc-like manner on and along the support face of the first interlocking member.

The multidirectional input device of this aspect has an advantageously small dimension in the overlapping direction of the first and second interlocking members of the device. This is because the second interlocking member is slidably disposed on the support face of the first interlocking member.

Alternatively, the first interlocking member may not be supported on the support of the operation lever but slidable in the first direction in an arc-like manner on and along the support face of the mount. The multidirectional input device of this aspect has an advantageously small dimension in the overlapping direction of the first and second interlocking members of the device. This is because the first interlocking member is slidably disposed on the support face of the mount and the second interlocking member is slidably disposed on the support face of the first interlocking member.

The multidirectional input device may further include a first slider and a second slider. The first slider may be movable in the first direction in accordance with movement of the first interlocking member. The first slider may include a first projection extending in the second direction. The second direction may be substantially orthogonal to the first direction. The second slider may be movable in the second direction in accordance with movement of the second interlocking member. The second slider may include a second projection extending in the first direction. The first interlocking member may include a first recess extending in a third direction. The third direction may be substantially orthogonal to the first direction and the second direction. The first projection of the first slider may be engaged in the first recess movably in the third direction. The second interlocking member may include a second recess extending in the third direction. The second projection of the second slider may be engaged in the second recess movably in the third direction.

The first slider may alternatively include a first recess extending in the third direction. The third direction may be substantially orthogonal to the first direction and the second direction. The second slider may alternatively include a second recess extending in the third direction. The first interlocking member may alternatively include a first projection extending in the second direction, and the first projection of the first interlocking member may be engaged in the first recess movably in the third direction. The second interlocking member may alternatively include a second projection extending in the first direction, and the second projection of the second interlocking member may be engaged in the second recess movably in the third direction.

In the multidirectional input device of these aspects, arc-like movements of the first and second interlocking members will not apply load to the part connecting between the first interlocking member and the first sliders (i.e. the first projection and the first recess) or to the part connecting between the second interlocking member and the second slider (i.e. the second projection and the second recess). This is because of that the first and second recesses extend in the third direction, and the first and second projections are respectively engaged in the first and second recesses movably in the third direction. Further, it is easy to couple the first interlocking member to the first slider and couple the second interlocking member to the second slider, only requiring engagement of the first and second projections with the first and second recesses, respectively.

The above multidirectional input device may further include a first guide and a second guide. The first guide may be configured to guide the first interlocking member movably in the first direction in an arc-like manner. The second guide may be configured to guide the second interlocking member movably in the second direction in an arc-like manner. In the multidirectional input device of this aspect, the first and second interlocking members can move in a stable manner because they are guided by the first and second guides.

The above multidirectional input device may further include a body. The body may include first and second housing portions and first and second guides. The first housing portion may house the first slider movably in the first direction. The second housing portion may house the second slider movably in the second direction. The first guide may be located at one side of the third direction relative to the first housing portion and may be configured to guide the first interlocking member to move in the first direction in an arc-like manner. The second guide may be located at one side of the third direction relative to the second housing portion and may be configured to guide the second interlocking member to move in the second direction in an arc-like manner.

In the multidirectional input device of this aspect, the first and second interlocking members can move in a stable manner because they are guided by the first and second guides.

The above multidirectional input device may further include a base and an elastic body. The elastic body may be interposed between the base and the mount, the elastic body supporting the mount in midair. In the multidirectional input device of this aspect, the operation lever is operated with a reduced load on the mount.

The elastic body may provide a biasing force to hold the support of the operation lever between the mount and the first interlocking member. In the multidirectional input device of this aspect, the operation lever can slide in a stable manner.

The operation lever may be movable in a third direction so as to depress the mount. The third direction may be substantially orthogonal to the first direction and the second direction. The mount as depressed may be movable against an elastic force of the elastic body. The multidirectional input device may further include a third detector configured to detect the movement of the operation lever.

The first detector may be configured to detect a direction and an amount of movement of the first interlocking member by detecting a direction and an amount of movement of the first slider. The second detector may be configured to detect a moving direction and a moving amount of movement of the second interlocking member by detecting a moving direction and a moving amount of movement of the second slider.

DESCRIPTION OF EMBODIMENT

A multidirectional input device according to a first embodiment of the invention will be described below with reference to FIGS. 1A to 4B.

First Embodiment

The multidirectional input device illustrated in FIGS. 1A to 4B includes an operation lever 100 that is operable from an neutral position in any radially outward direction and also in a Z2 direction to perform corresponding input. The input device includes the operation lever 100, first and second interlocking members 200*a* and 200*b*, a pair of first sliders 300*a*, a pair of second sliders 300*b*, a body 400, a cover 500*a*, a frame 500*b*, a mount 600, a circuit board 700, first, second, and third detectors 800*a*, 800*b*, 800*c*, a pair of first return mechanisms 900*a*, a pair of second return mechanisms 900*b*, and an elastic member 900*c*. These constituents of the multidirectional input device will be described below in detail. An X1-X2 direction indicated in FIGS. 2A, 2C, 2D, and 3A to 3B corresponds to the first direction in the claims. A Y1-Y2 direction indicated in FIGS. 2B, 2C, and 2E to 3B corresponds to the second direction in the claims. A Z1-Z2 direction indicated in FIGS. 2A to 3B is the height direction of the multidirectional input device and corresponds to the third direction in the claims. The Y1-Y2 direction is substantially orthogonal to the X1-X2 direction. The Z1-Z2 direction is substantially orthogonal to the Y1-Y2 direction and the X1-X2 direction.

Figure 2A:
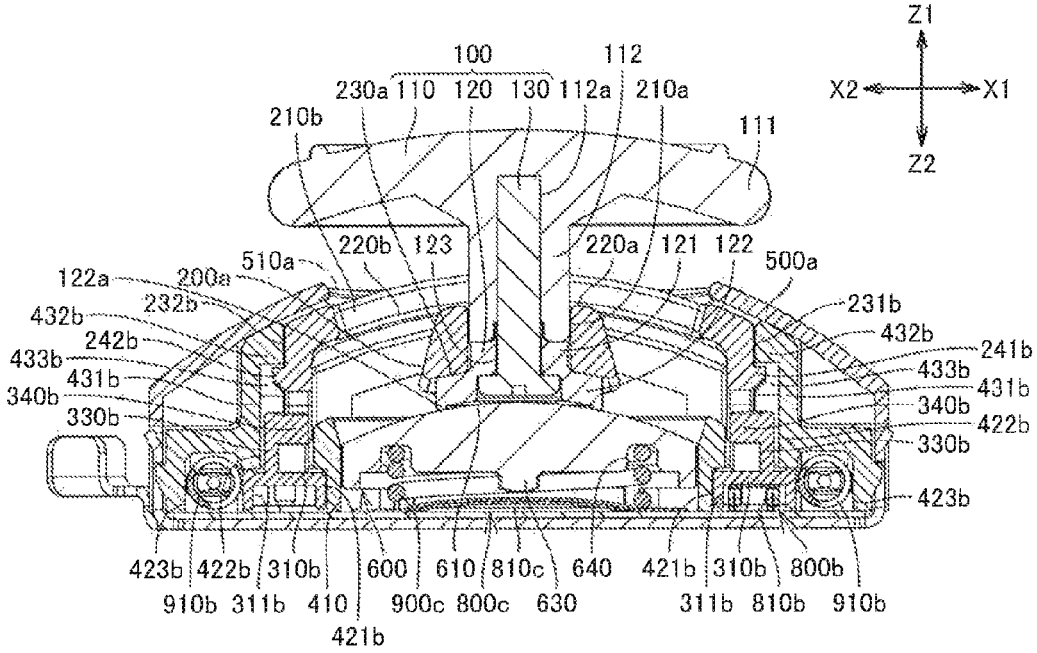
FIG. 2A is a cross-sectional view of the input device taken along line 2A-2A in FIG. 1A.
Figure 2B:
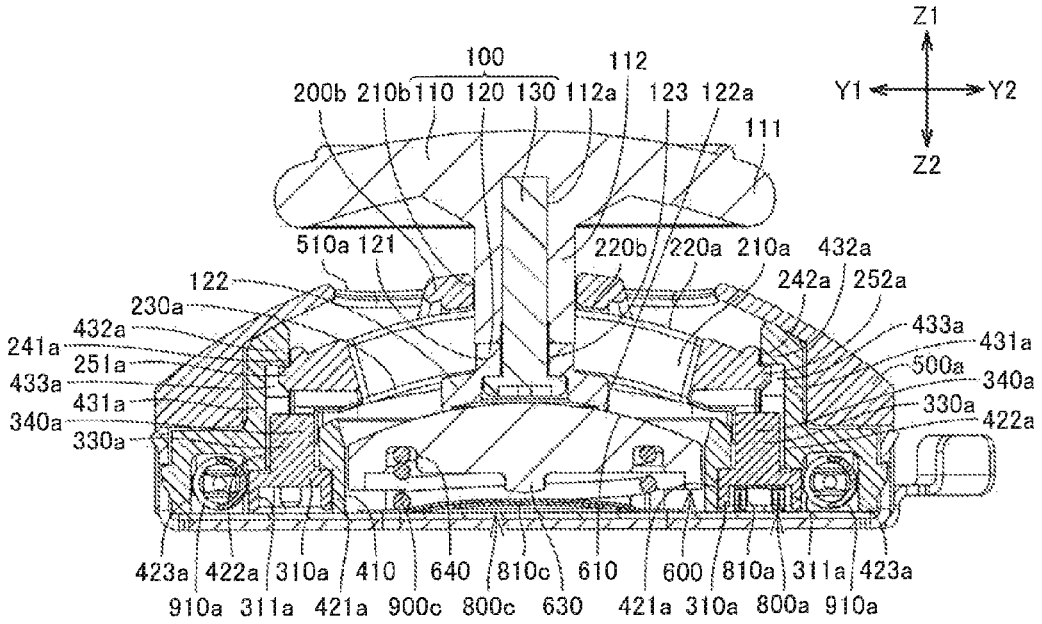
FIG. 2B is a cross-sectional view of the input device taken along line 2B-2B in FIG. 1A.
Figure 2C:
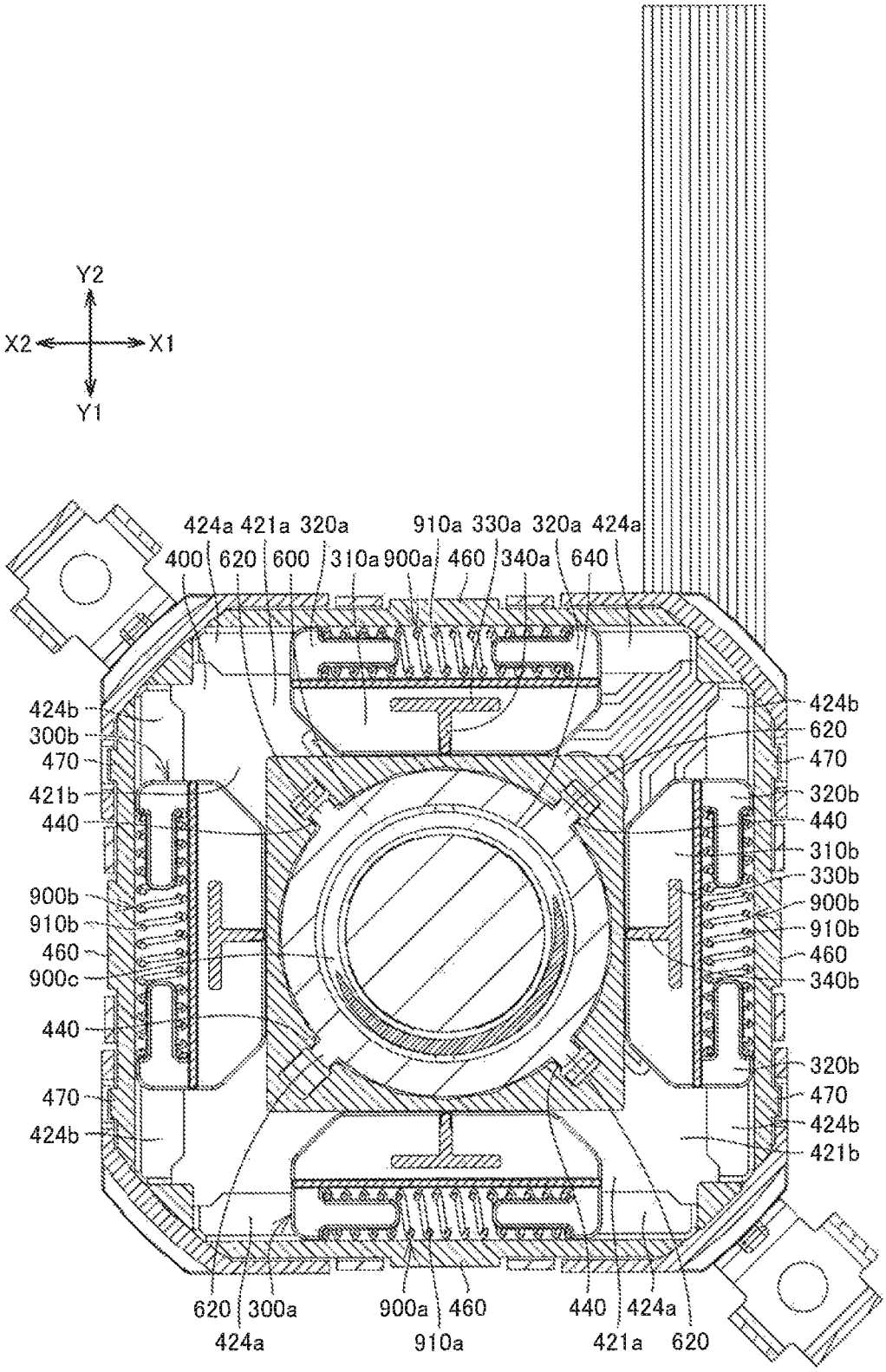
FIG. 2C is a cross-sectional view of the input device taken along line 2C-2C in FIG. 1A.

As illustrated in FIGS. 2A to 2C, the mount 600 is a generally cylindrical member of an insulating resin. The mount 600 includes a support face 610, four guide projections 620, a protrusion 630, and a ring hole 640. The guide projections 620 are arranged around the outer peripheral face of the mount 600, spaced at 90° intervals to radially extend from the mount 600. The support face 610 is the upper face (Z1-direction end face) of the mount 600 and is of generally spherically convex shape. The protrusion 630 is a generally cylindrical protrusion in the center of the lower face (Z2-direction end face) of the mount 600 and extends in the Z1-Z2 direction. The ring hole 640 is a bottomed ring-shaped hole in the peripheral portion of the lower face of the mount 600.

As best illustrated in FIGS. 2A and 2B, the operation lever 100 is supported on the support face 610 of the mount 600 so as to be slidable from the neutral position. The operation lever 100 can also move in the Z1-Z2 direction from the neutral position together with the mount 600. As illustrated in FIGS. 2A and 2B, the neutral position of the operation lever 100 of the first embodiment is a position where the centers of shafts 112, 121 (to be described) of the operation lever 100 are located along the vertical line passing through the vertex of the support face 610 of the mount 600 and the first and second interlocking members 200*a*, 200*b* abut first and second guides 430*a*, 430*b* (to be described) of the body 400.

The operation lever 100 includes a key top 110, a slidable part 120, and an attachment member 130. The slidable part 120 includes the shaft 121, a support 122, and a through-hole 123. The support 122, generally discoid, is disposed between the support face 610 of the mount 600 and the first interlocking member 200*a*. The upper face (Z1-direction end face) of the support 122 has a generally spherical convexed shape, corresponding to the shape of the support face 610 of the mount 600. The lower face (Z2-direction end face) of the support 122 is provided with a ring-shaped protrusion 122*a*. The protrusion 122*a* is slidable along the support face 610 of the mount 600. This arrangement can reduce friction between the slidable part 120 and the support face 610 when the slidable part 120 slides on and along the support face 610. The shaft 121 is a square prism extending from the center of the upper face of the support 122. The shaft 121 has outer dimensions in the X1-X2 and Y1-Y2 directions that are equal to those of the shaft 112 but smaller than those of the support 122. The through-hole 123 extends in the Z1-Z2 direction through the central portion of the slidable part 120.

The key top 110 includes a discoid operable portion 111 and the shaft 112. The shaft 112 is of generally square prism shape extending in the Z1-Z2 direction from the center of the lower face (Z2-direction end face) of the operable portion 111. The shaft 112 is attached to the upper face (Z1-direction end face) of the shaft 121 of the slidable part 120. The shaft 112 has an attachment hole 112*a* in communication with the through-hole 123.

The attachment member 130 is a metal screw. The attachment member 130 passes through the through-hole 123 of the slidable part 120 and screws in the attachment hole 112*a* of the shaft 112 of the key top 110. The attachment member 130 serves to attach the slidable part 120 to the key top 110. The attachment member 130, made of metal, also serves to reinforce the operation lever 100. The attachment member 130 may be a screw of plastic material instead.

Figure 3A:
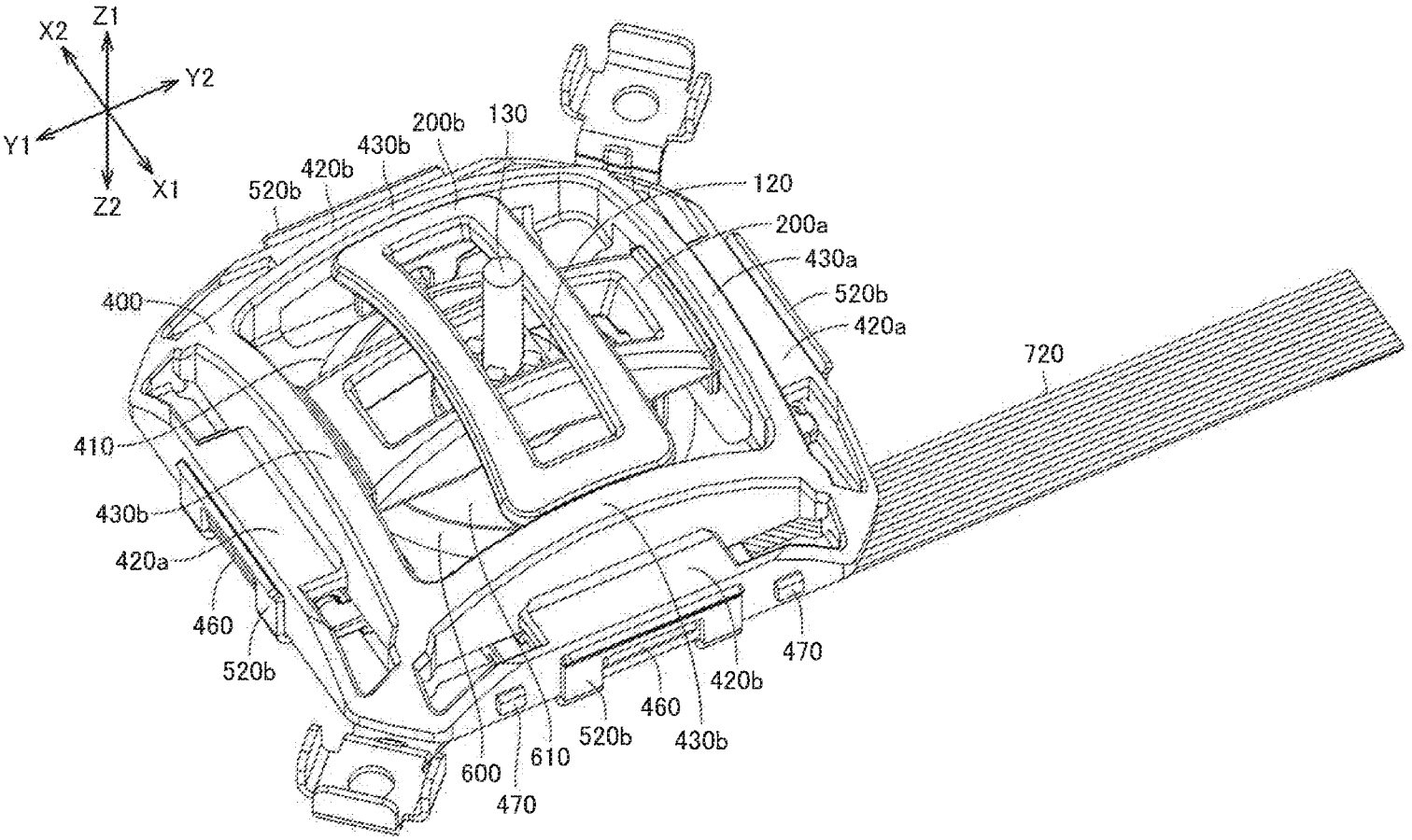
FIG. 3A is a front, top, and right side perspective view of the input device, with a key top of an operation lever and a cover removed.
Figure 3B:
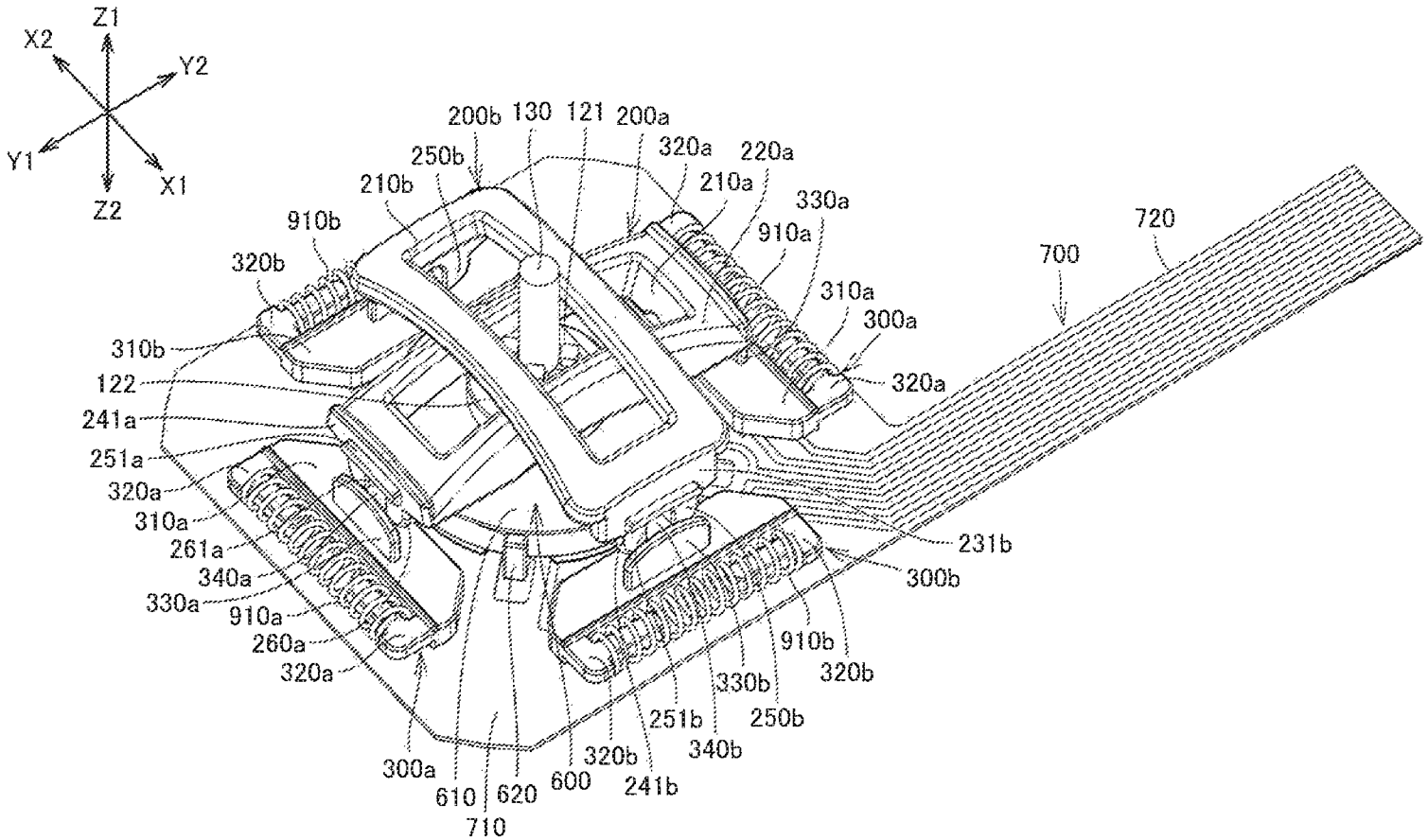
FIG. 3B is a front, top, and right side perspective view of the input device, with the key top of the operation lever, the cover, and a body removed.

The circuit board 700 may be a flexible printed circuits (FPC) or may be a PET-based circuit board. As best illustrated in FIG. 3B, the circuit board 700 includes a board body 710 (corresponding to the base in the claims) and a connection portion 720. The board body 710 is a rectangular member having a central portion, a Y1-direction end, a Y2-direction end, an X1-direction end, and an X2-direction end. The connection portion 720 is contiguous with the board body 710. The connection portion 720 serves as an external connection portion connectable to e.g. a control part of an electronic device to install the multidirectional input device of the invention.

As best illustrated in FIGS. 2A and 2B, the elastic member 900*c* is a coil spring interposed between the central portion of the circuit board main body 710 and the mount 600 to support the mount 600 in midair. The Z1-direction end of the elastic member 900*c* is housed in the ring hole 640 of the mount 600. The elastic member 900*c* is compressed between the central portion of the board body 710 and the mount 600 in accordance with movement in the Z2 direction of the operation lever 100 and the mount 600. The elastic member 900*c* biases the mount 600 in the Z1 direction so as to restore the operation lever 100 to the neutral position.

As best illustrated in FIGS. 2A and 2B, the third detector 800*c* is a depression switch for detecting movement in the Z2 direction of the operation lever 100. The third detector 800*c* includes a movable contact 810*c* and a pair of first and second stationary contacts (not shown). The first stationary contact is formed on the center of the board body 710, and the second stationary contact surrounds the first stationary contact on the board body 710. The movable contact 810*c* is a metal plate of dome shape or arc shape that is convexed in the Z1 direction. The movable contact 810*c* is fixed on the board body 710 with an adhesive tape so as to be in contact with the second stationary contact. The apex of the movable contact 810*c* is disposed above and in spaced relation to the first stationary contact, under and in spaced relation to the protrusion 630 of the mount 600. When the apex of the movable contact 810*c* is depressed in the Z2 direction by the protrusion 630 of the mount 600, the movable contact 810*c* elastically deforms so that its apex is brought into contact with the first stationary contact. As a result, the pair of stationary contacts are brought into conduction with each other, and the third detector 800*c* can detect the movement in the Z2 direction of the operation lever 100.

As best illustrated in FIG. 3B, the first interlocking member 200*a* extends in the Y1-Y2 direction and is movable in an arc-like manner in the X1-X2 direction in accordance with movement in the X1-X2 direction of the operation lever 100. The first interlocking member 200*a* includes an elongated hole 210*a*, a support face 220*a*, an abuttable face 230*a*, guide faces 241*a* and 242*a*, guide projections 251*a* and 252*a*, and a pair of engagement portions 260*a*.

The support face 220*a* is the upper face (Z1-direction end face) of the first interlocking member 200*a*. The support face 220*a* extends in the Y1-Y2 direction in an arc-like manner. The abuttable surface 230*a* is the lower face (Z2-direction end face) of the first interlocking member 200*a*. The abuttable face 230*a* abuts the support 122 of the operation lever 100. In other words, the first interlocking member 200*a* is supported on the support 122 of the operation lever 100, in spaced relation to the support face 610 of the mount 600. This arrangement allows the first interlocking member 200*a* to move in the Z2 direction in response to the movement in the Z2 direction of the operation lever 100. The abuttable face 230*a* extends in the Y1-Y2 direction in an arc-like manner, i.e. it is concaved in a generally spherical shape corresponding to the shape of the support face 610 of the mount 600. This arrangement allows the support 122 to move in the Y1-Y2 direction along the abuttable face 230*a* of the first interlocking member 200*a* and the support face 610 of the mount 600.

The elongated hole 210*a* is a generally rectangular hole passing through the first interlocking member 200*a* in the Z1-Z2 direction and extends in the Y1-Y2 direction. The elongated hole 210*a* is slightly larger in X1-X2 direction dimension than each of the shafts 112, 121 of the operation lever 100. The shafts 112, 121 of the operation lever 100 are inserted through the elongated hole 210*a* so as to be movable in the Z1-Z2 and Y1-Y2 directions. In other words, the shafts 112, 121 of the operation lever 100 pass through the first interlocking member 200*a* in the Z1-Z2 direction. The elongated hole 210*a* of the first interlocking member 200*a* has an X1-direction inner wall and an X2-direction inner wall facing the shafts 112, 121 of the operation lever 100 in contact therewith or with narrow clearances therefrom. When the operation lever 100 is located at the neutral position, the shafts 112, 121 of the operation lever 100 regulate the positions of the X1-direction inner wall and the X2-direction inner wall of the first interlocking member 200*a* so as to maintain the first interlocking member 200*a* in its initial position. When the shafts 112, 121 press the X1-direction inner wall, the first interlocking member 200*a* is displaced from the initial position in the X1 direction in an arc-like manner. When the shafts 112, 121 presses the X2-direction inner wall, the first interlocking member 200*a* is displaced from the initial position in the X2 direction in an arc-like manner.

The guide face 241*a* is the Y1-direction end face of the first interlocking member 200*a*. The guide face 242*a* is the Y2-direction end face of the first interlocking member 200*a*. The guide projection 251*a* is provided on the guide face 241*a*. The guide projection 252*a* is provided on the guide face 242*a*. The guide projections 251*a*, 252*a* are ridges extending in an arc-like manner in the X1-X2 direction.

One of the engagement portions 260*a* extends in the Z2 direction from the Y1-direction end of the first interlocking member 200*a*, and the other engagement portion 260*a* extends in the Z2 direction from the Y2-direction end of the first interlocking member 200*a*. The engagement portions 260*a* are each provided with a recess 261*a* (corresponding to the first recess of the first interlocking member in the claims). The recesses 261*a* extend in the Z1-Z2 direction, pass through the engagement portions 260*a* in the Y1-Y2 direction, and open in the Z2 direction.

As best illustrated in FIG. 3B, the second interlocking member 200*b* extends in the X1-X2 direction and is movable in an arc-like manner in the Y1-Y2 direction in accordance with movement in the Y1-Y2 direction of the operation lever 100. The second interlocking member 200*b* is placed on top of the first interlocking member 200*a*. The second interlocking member 200*b* includes an elongated hole 210*b*, an abuttable face 220*b*, guide faces 231*b* and 232*b*, guide projections 241*b* and 242*b*, and a pair of engagement portions 250*b*.

The abuttable face 220*b* is the lower face (Z2-direction end face) of the second interlocking member 200*b*. The abuttable face 220*b* extends in an arc-like manner in the X1-X2 direction. The abuttable face 220*b* abuts the support face 220*a* of the first interlocking member 200*a*. In other words, the second interlocking member 200*b* placed on the first interlocking member 200*a* is supported by the first interlocking member 200*a*. This arrangement allows the second interlocking member 200*b* to move in the Z2 direction in accordance to the movement in the Z2 direction of the first interlocking member 200*a*.

The elongated hole 210*b* is a generally rectangular hole passing through the second interlocking member 200*b* in the Z1-Z2 direction and extends in the X1-X2 direction. The elongated hole 210*b* is slightly larger in Y1-Y2 direction dimension than the shaft 112 of the operation lever 100. The shaft 112 of the operation lever 100 is inserted through the elongated hole 210*b* so as to be movable in the Z1-Z2 and X1-X2 directions. In other words, the shaft 112 of the operation lever 100 passes through the second interlocking member 200*b* in the Z1-Z2 direction. The elongated hole 210*b* of the second interlocking member 200*b* has a Y1-direction inner wall and a Y2-direction inner wall facing the shaft 112 of the operation lever 100 in contact therewith or with narrow clearances therefrom. When the operation lever 100 is located at the neutral position, the shaft 112 of the operation lever 100 regulates the positions of the Y1-direction inner wall and the Y2-direction inner wall of the second interlocking member 200*b* so as to maintain the second interlocking member 200*b* in its initial position. When the shaft 112 presses the Y1-direction inner wall, the second interlocking member 200*b* is displaced from the initial position in the Y1 direction in an arc-like manner. When the shaft 112 presses the Y2-direction inner wall, the second interlocking member 200*b* is displaced from the initial position in the Y2 direction in an arc-like manner.

The guide face 231*b* is the X1-direction end face of the second interlocking member 200*b*. The guide face 232*b* is the X2-direction end face of the second interlocking member 200*b*. The guide projection 241*b* is provided on the guide face 231*b*. The guide projection 242*b* is provided on the guide face 232*b*. The guide projections 241*b*, 242*b* are ridges extending in an arc-like manner in the Y1-Y2 direction.

One of the engagement portions 250*b* extends in the Z2 direction from the X1-direction end of the second interlocking member 200*b*, and the other engagement portion 250*b* extends in the Z2 direction from the X2-direction end of the second interlocking member 200*b*. The engagement portions 250*b* are each provided with a recess 251*b* (corresponding to the second recess of the second interlocking member in the claims). The recesses 251*b* extend in the Z1-Z2 direction, pass through the engagement portions 250*b* in the X1-X2 direction, and open in the Z2 direction.

The first sliders 300*a* are best illustrated in FIG. 3B. One of the first sliders 300*a* is disposed on the Y1-direction end portion of the board body 710 so as to be movable in the X1-X2 direction. The other first slider 300*a* is disposed on the Y2-direction end portion of the board body 710 so as to be movable in the X1-X2 direction. Each of the first sliders 300*a* includes a slider body 310*a*, a pair of arms 320*a*, a wall 330*a*, and a projection 340*a* (corresponding to the first projection of the first slider in the claims). The slider body 310*a* is a block generally of trapezoidal shape in plan view. The slider main body 310*a* has an upper face (Z1-direction end face), a lower face (Z2-direction end face), an inner face (face corresponding to the upper/shorter base of the trapezoidal slider body 310*a*), and an outer face (face corresponding to the lower/longer base of the trapezoidal slider body 310*a*). The lower face of the slider body 310*a* has a housing recess 311*a* (see FIG. 2B). The arms 320*a*, generally L-shaped in plan view, extend from the respective outer faces of the sider body 310*a*, with the tips of the arms 320*a* facing each other. The tips of the arms 320*a* are inserted into a spring 910*a* (to be described) of each first return mechanism 900*a* from the opposite ends of the spring 910*a*. In other words, the spring 910*a* is held between the arms 320*a*.

The wall 330*a* stands on the upper face of the slider body 310*a*. The wall 330*a* has an inner face, which faces in the same direction as the inner face of the slider main body 310*a*. The projection 340*a* extends in the Y1-Y2 direction from the inner face of the wall 330*a*. The projection 340*a* is engaged in the recess 261*a* of the engagement portion 260*a* of the associated first interlocking member 200*a* so as to be movable in the Z1-Z2 direction relative to the recess 261*a*. When the associated first interlocking member 200*a* moves in the X1-X2 direction, the engagement portion 260*a* presses the projection 340*a* to move the first slider 300*a* in the X1-X2 direction.

The second sliders 300*b* are best illustrated in FIG. 3B, One of the second sliders 300*b* is disposed on the X1-direction end portion of the board body 710 so as to be movable in the Y1-Y2 direction. The other second slider 300*b* is disposed on the X2-direction end portion of the board body 710 so as to be movable in the Y1-Y2 direction. Each of the second sliders 300*b* has the same configuration as the first slider 300*a* and accordingly includes a slider body 310*b*, a pair of arms 320*b*, a wall 330*b*, and a projection 340*b* (corresponding to the second projection of the second slider in the claims). The projection 340*b* is engaged in the recess 251*b* of the engagement portion 250*b* of the associated second interlocking member 200*b* so as to be movable in the Z1-Z2 direction relative to the recess 251*b*. When the associated second interlocking member 200*b* moves in the Y1-Y2 direction, the engagement portion 250*b* presses the projection 340*b* to move the second slider 300*b* in the Y1-Y2 direction. The tips of the arms 320*b* are inserted into a spring 910*b* (to be described) of each second return mechanism 900*b* from opposite ends of the spring 910*b*. In other words, the spring 910*b* is held between the arms 320*b*.

The first detector 800*a* is used to detect directions and amounts of movements of the first interlocking member 200*a* by detecting directions and amounts of movements of the Y2-direction-side one of the first sliders 300*a*. In the first embodiment, the first detector 800*a* illustrated in FIG. 2B is a variable resistor used to detect directions and amounts of movements of the Y2-direction-side first slider 300*a* as changes in electrical resistance. The first detector 800*a* includes a contactor 810*a*, a resistor (not shown), and a conductor (not shown). The resistor and the conductor are formed on the Y2-direction end portion of the board body 710. The resistor and the conductor generally extend in the X1-X2 direction in parallel to each other. The contactor 810*a* is fixed to the top face (Z1-direction face) of the housing recess 311*a* of the Y2-direction-side first slider 300*a* to be housed inside the housing recess 311*a*. The contactor 810*a* is in contact with the resistor and the conductor to electrically conduct the resistor and the conductor. The contactor 810*a* can slide on and along the resistor and the conductor in accordance with movements in the X1-X2 direction of the Y2-direction-side first slider 300*a*. When the contactor 810*a* slides on the resistor and the conductor, the electrical resistance in the first detector 800*a* changes.

The second detector 800*b* is used to detect directions and amounts of movements of the second interlocking member 200*b* by detecting directions and amounts of movements of the X1-direction-side one of the second sliders 300*b*. In the first embodiment, the second detector 800*b* illustrated in FIG. 2A is a variable resistor used to detect directions and amounts of movements of the X1-direction-side second slider 300*b* as changes in electrical resistance. The second detector 800*b* includes a contactor 810*b*, a pair of resistors (not shown), and a conductor (not shown). The resistors and the conductor are formed on the X1-direction end portion of the board body 710. The resistors and the conductor extend in the Y1-Y2 direction. The contactor 810*b* is fixed to the top face (Z1-direction face) of the housing recess 311*b* of the X1-direction-side second slider 300*b* to be housed inside the housing recess 311*b*. The contactor 810*b* is in contact with the resistors and the conductor to electrically conduct the resistors and the conductor. The contactor 810*b* can slide on and along the resistors and the conductor in response to movements in the Y1-Y2 direction of the X1-direction-side second slider 300*b*. When the contactor 810*b* slides on the resistors and the conductor, the electrical resistance in the second detector 800*b* changes.

Figure 4A:
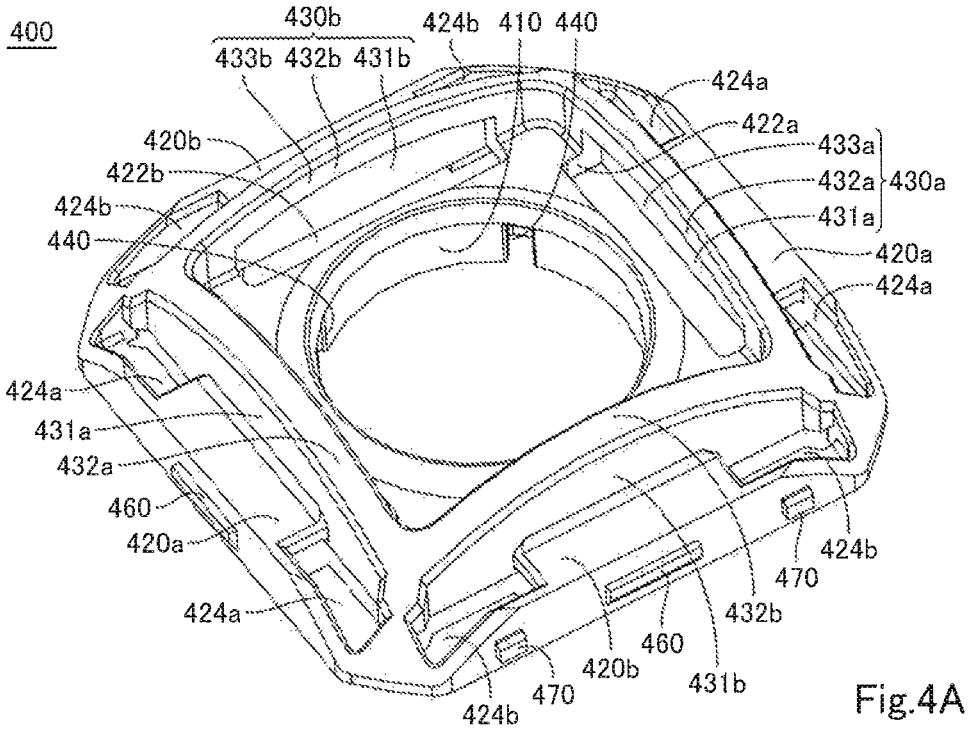
FIG. 4A is a front, top, right side perspective view of the body of the input device.
Figure 4B:
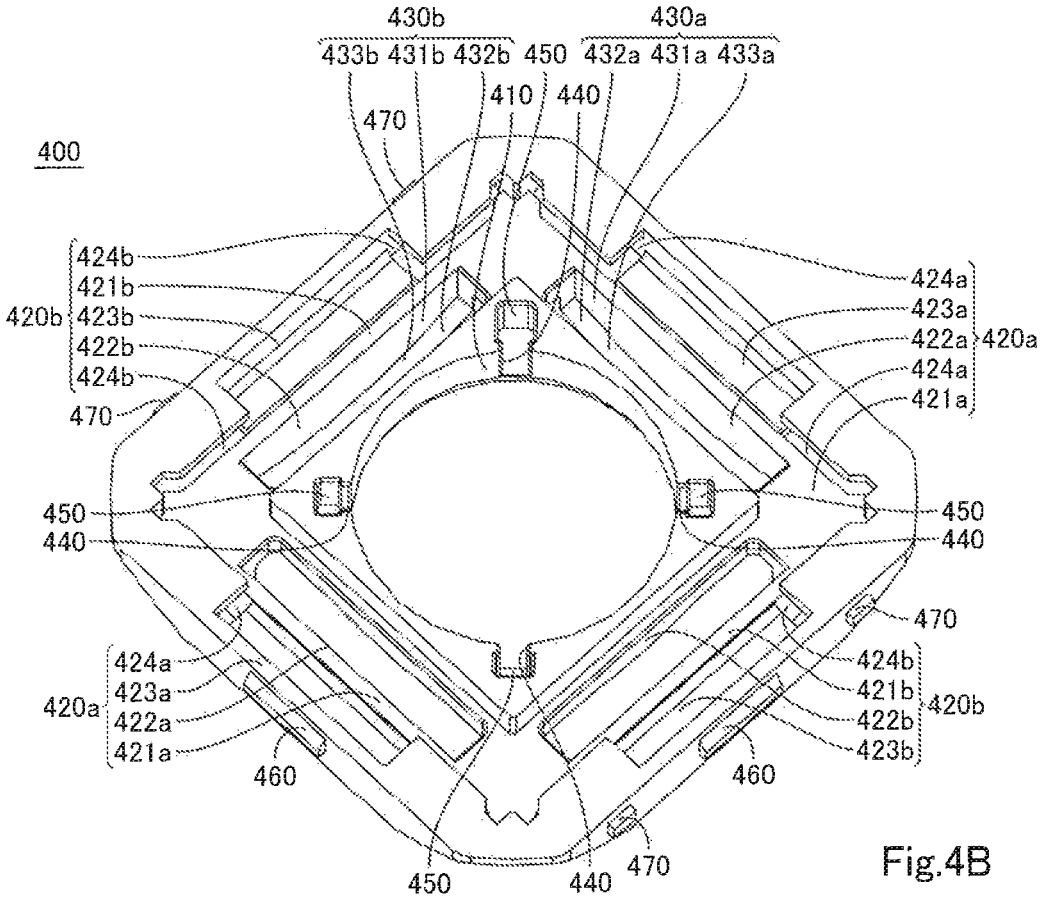
FIG. 4B is a rear, bottom, right side perspective view of the body of the input device.

The body 400 is made of an insulating resin. The body 400 is disposed on the board body 710 of the circuit board 700. As best illustrated in FIGS. 4A and 4B, the body 400 includes an opening 410, a pair of first housing portions 420*a*, a pair of second housing portions 420*b*, a pair of first guides 430*a*, a pair of second guides 430*b*, four guide holes 440, four engagement holes 450, four engagement projections 460, and four engagement projections 470.

The engagement projections 460 are each provided on each one of the four outer faces of the body 400. Two of the engagement projections 470 are provided on the X1-direction outer face of the body 400 to be located on opposite sides of the one of the engagement projection 460. The other two engagement projections 470 are provided on the X2-direction outer face of the body 400 to be located on opposite sides of the other engagement projection 460.

The opening 410 is a columnar hole passing through the central portion of the body 400 in the Z1-Z2 direction. The opening 410 has a diameter that is slightly larger than the outer diameter of the mount 600. The four guide holes 440 are formed around the opening 410 of the body 400 at approximately 90° intervals. The guide holes 440 pass through the surrounding area of the opening 410 of the body 400 in the Z1-Z2 direction and communicate with the opening 410. The opening 410 receive the mount 600 movably in the Z1-Z2 direction. The guide holes 440 receive the guide projections 620 of the mount 600 movably in the Z1-Z2 direction to suppress wobbling the mount 600. The four engagement holes 450 are bottomed holes in the lower face (Z2-direction end face) of the body 400 and located on the outside of and in communication with the respective guide holes 440.

The first housing portions 420*a* house the respective first sliders 300*a* movably in the X1-X2 direction. One of the first housing portions 420*a* is provided along the Y1-direction end portion of the body 400, and the other first housing portion 420*a* is provided along the Y2-direction end portion of the body 400. One of the first housing portions 420*a* has a lower track 421*a*, an upper track 422*a*, a spring hole 423*a*, and a pair of slits 424*a*.

As best illustrated in FIG. 4B, the lower track 421*a* is a bottomed hole extending in the X1-X2 direction in the Y1-direction end portion of the lower face of the body 400. The lower track 421*a* is larger in X1-X2 direction dimension and slightly larger in the Y1-Y2 direction dimension than the slider body 310*a* of the first slider 300*a*. The lower track 421*a* receives the slider body 310*a* movably in the X1-X2 direction.

The upper track 422*a* is formed centrally in the ceiling (Z1-direction face) of the lower track 421*a* of the body 400. The upper track 422*a* is a hole extending in the X1-X2 direction so as to communicate with the lower track 421*a* and open in the Z1 direction. The upper track 422*a* is smaller in X1-X2 direction dimension than the lower track 421*a*. The upper track 422*a* receives the lower portion of the wall 330*a* of the first slider 300*a* movably in the X1-X2 direction.

The spring hole 423*a* is a bottomed hole extending in the X1-X2 direction in the lower face of the body 400, more particularly on the Y1 direction side of the Y1-direction-side one of the lower track 421*a* of the body 400. The spring hole 423*a* is smaller in X1-X2 direction dimension (longitudinal direction dimension) and slightly larger in the Y1-Y2 direction dimension (short direction dimension) than of the spring 910*a* of each first return mechanisms 900*a*. The spring hole 423*a* houses the spring 910*a* in a compressed state and the tips of the pair of arms 320*a* of the first slider 300*a* as received in the spring 910*a*.

The slits 424*a* are provided on opposite sides in the X1-X2 direction of the spring hole 423*a* of the body 400. The slits 424*a* extend in the X1-X2 direction, communicate with the spring hole 423*a* and the lower track 421*a*, and open in the Z1 direction. The slits 424*a* receive the respective basal end portions of the arms 320*a* of the first slider 300*a* movably in the X1-X2 direction.

The other first housing portion 420*a* has a similar configuration as the one of the first housing portions 420*a*. The differences are that the other first housing portion 420*a* is provided in a different portion of the body 400 as described above and is a mirror image in the Y1-Y2 direction. Accordingly, detailed descriptions will not be provided.

The first guides 430*a* guide the first interlocking member 200*a* to move in the X1-X2 direction in an arc-like manner. One of the first guides 430*a* is located at the Z1-direction side relative to the one of the first housing portions 420*a* (located above the level of the one of the first housing portions 420*a*). The other first guide 430*a* is located at the Z1-direction side relative to the other first housing portion 420*a* (located above the level of the other first housing portion 420*a*). The one of the first housing portions 420*a* includes a wall 431*a*, a ridge 432*a*, and a space 433*a*. The wall 431*a* extends in the Z1-Z2 direction from the Y1-direction wall of the upper track 422*a* of the one of the first housings 420*a*. The Z1-direction end of the wall 431*a* is provided with the ridge 432*a*, which an arc-shaped ridge convexed in the Y2 direction.

The wall 431*a* and the ridge 432*a* define the space 433*a*, which is located on the Z1-direction side the upper track 422*a* and communicates with the upper track 422*a*. The space 433*a* open inward (in the Y2 direction). The upper part of the wall 330*a* of the first slider 300*a* is housed movably in the X1-X2 direction inside the space 433*a* and the upper track 422*a*. The projection 340*a* of the associated first slider 300*a* projects inward (in the Y2 direction) through the space 433*a* to be engaged with the recess 261*a* of each engagement portion 260*a* of the first interlocking member 200*a*. The ridge 432*a* has an arc-shaped lower face corresponding to the arc-shaped route of the guide projection 251*a* of the first interlocking member 200*a*. The ridge 432*a* serves to guide the guide projection 251*a* movably in an arc-like manner in the X1-X2 direction. The inner face of the ridge 432*a* faces the guide face 241*a* of the first interlocking member 200*a* to guide the guide face 241*a* movably in the X1-X2 direction.

The other first guide 430*a* has a similar configuration as the one of the first guide 430*a*. The differences are that the other first guide 430*a* is provided in a different portion on the body 400 and an mirror-image the Y1-Y2 direction. Accordingly, detailed descriptions will not be provided. The ridge 432*a* of the other first guide 430*a* has an arc-shaped lower face corresponding to the arc-shaped route of the guide projection 252*a* of the first interlocking member 200*a*. The ridge 432*a* serves to guide the guide projection 252*a* movably in an arc-like manner in the X1-X2 direction. The inner face of the ridge 432*a* faces the guide face 242*a* of the first interlocking member 200*a* to guide the guide face 242*a* movably in the X1-X2 direction.

The second housing portions 420*b* house the respective second sliders 300*b* movably in the Y1-Y2 direction. One of the second housing portions 420*b* is provided in the X1-direction end portion of the body 400, and the other second housing portion 420*b* is provided in the X2-direction end portion of the body 400. The second housing portions 420*b* have a similar configuration as the first housing portions 420*a* described above and accordingly will not be described with regarding the overlapping features. The second housing portions 420*b* each include a lower track 421*b*, an upper track 422*b*, a spring hole 423*b*, and a pair of slits 424*b*. The lower track 421*b* of the one of the second housing portions 420*b* communicates with the X1-direction ends of both of the lower tracks 421*a*. The lower track 421*b* of the other second housing portion 420*b* communicates with the X2-direction ends of both of the lower tracks 421*a*. In short, the four lower tracks 421*a* and 421*b* form a square frame-like recess.

The second guides 430*b* guide the second interlocking member 200*b* to move in the Y1-Y2 direction in an arc-like manner. One of the second guides 430*b* is located at the Z1-direction side relative to the one of the second housing portions 420*b* (located above the level of the one of the second housing portions 420*b*). The other second guide 430*b* is located at the Z1-direction side relative to the other second housing portion 420*b* (located above the level of the other second housing portion 420*b*). The second guides 430*b* each include a wall 431*b*, a ridge 432*b*, and a space 433*b*. The wall 431*b* of each of second guides 430*b* has the same configuration as the wall 431*a* of each of the first guides 430*a*, except that the wall 431*b* is larger in Z1-Z2 direction than the wall 431*a*. Accordingly, descriptions will not be provided with regard to features of the wall 431*b* overlapping with those of the wall 431*a*. The ridge 432*b* of each of the second guides 430*b* has the same configuration as the ridge 432*a* of each of the first guides 430*a*, except that the ridge 432*b* has an arc-shaped lower face corresponding to the arc-shaped route of the guide projection 241*b* or 242*b* of the second interlocking member 200*b*. Accordingly, descriptions will not be provided with regard to features of the ridge 432*b* overlapping with those of the ridge 432*a*.

Figure 1A:
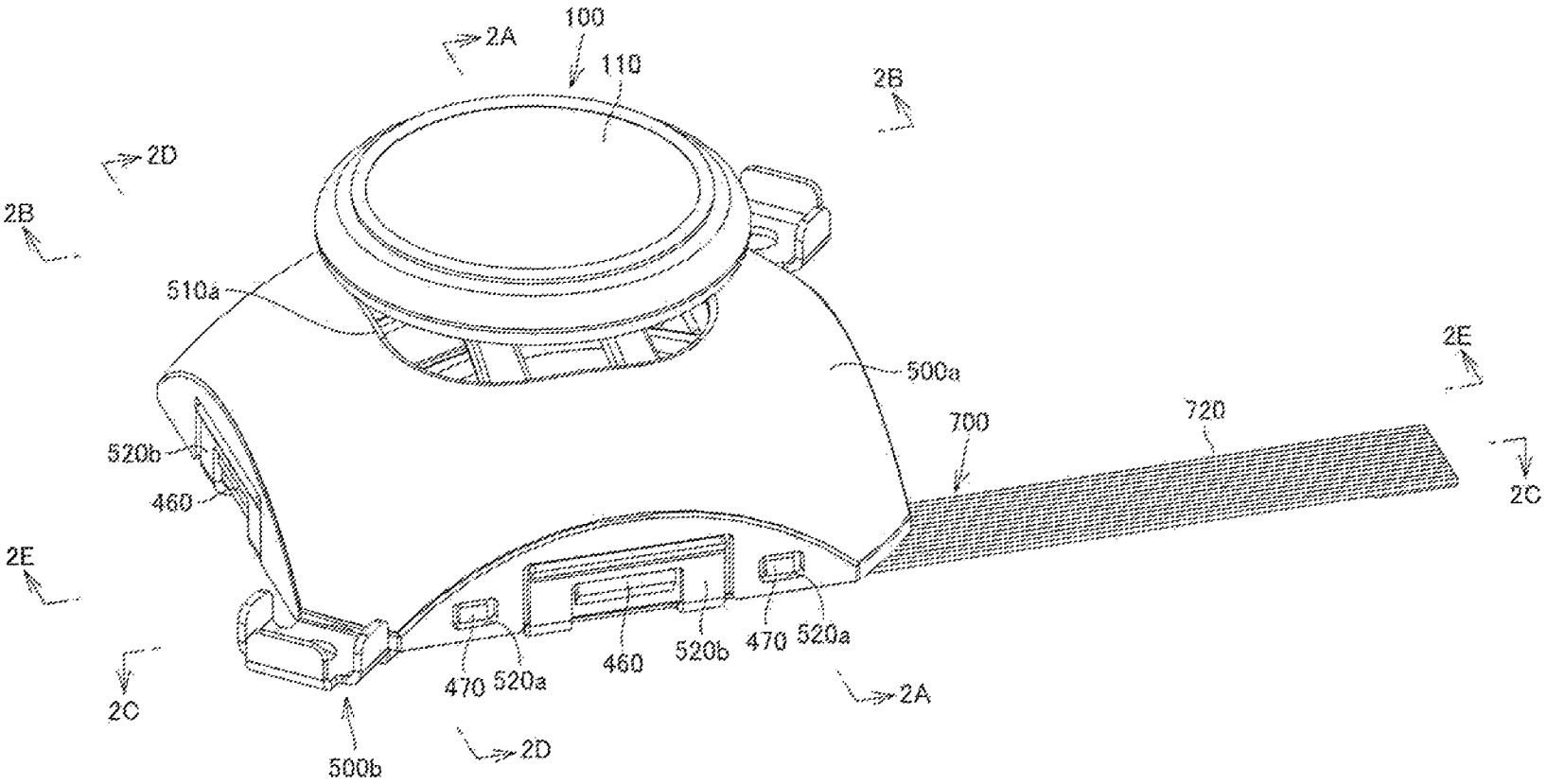
FIG. 1A is a front, top, right side perspective view of a multidirectional input device according to a first embodiment of the invention.

As best illustrated in FIG. 1A, the cover 500*a* is attached to the body 400 to partially cover the first and second interlocking members 200*a*, 200*b*. The cover 500*a* has an opening 510*a* and four engagement holes 520*a*. The opening 510*a* is a generally rectangular hole passing through the apex area of the cover 500*a*. As illustrated in FIGS. 2A and 2B, the opening 510*a* receives therethrough the shaft 112 of the operation lever 100. Two of the engagement holes 520*a* are provided in the X1-direction outer wall of the cover 500*a* and engaged with the respective engagement projections 470 on the X1-direction side of the body 400. The other two engagement holes 520*a* are provided in the X2-direction outer wall of the cover 500*a* and engaged with the respective engagement projections 470 on the X2-direction side of the body 400.

Figure 1B:
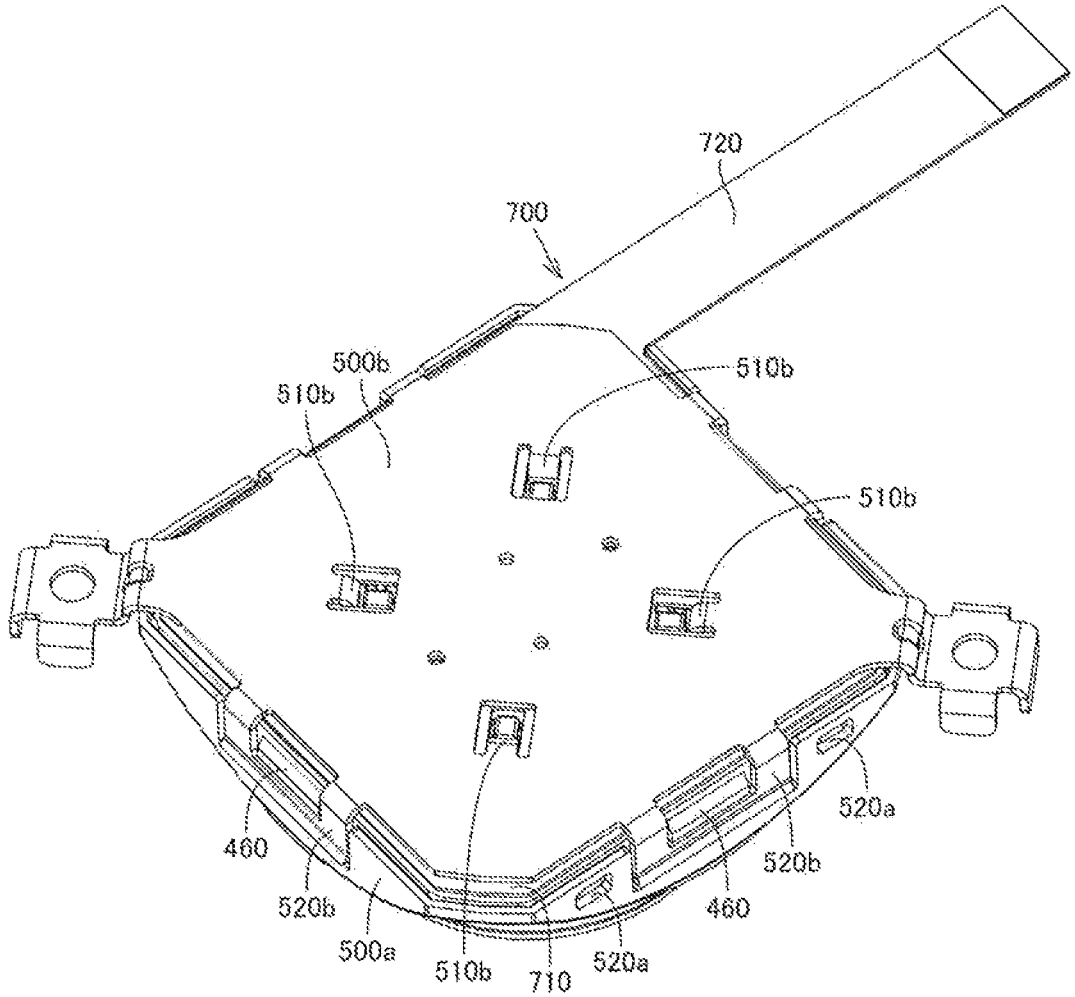
FIG. 1B is a front, bottom, left side perspective view of the input device.

As best illustrated in FIG. 1B, the frame 500*b* is a generally rectangular metal plate disposed under the board body 710. The frame 500*b* includes four engagement pieces 510*b* and four engagement pieces 520*b*. The engagement pieces 510*b* are disposed in the central portion of the frame 500*b* at 90° intervals. The engagement pieces 510*b* pass through the board body 710 to be engaged with the respective engagement holes 450 of the body 400. The engagement pieces 520*b* are disposed on the respective four sides of the frame 500*b*. The engagement pieces 520*b* are each provided with an engagement hole. Each engagement holes is engaged with each engagement projection 460 of the body 400.

Figure 2D:
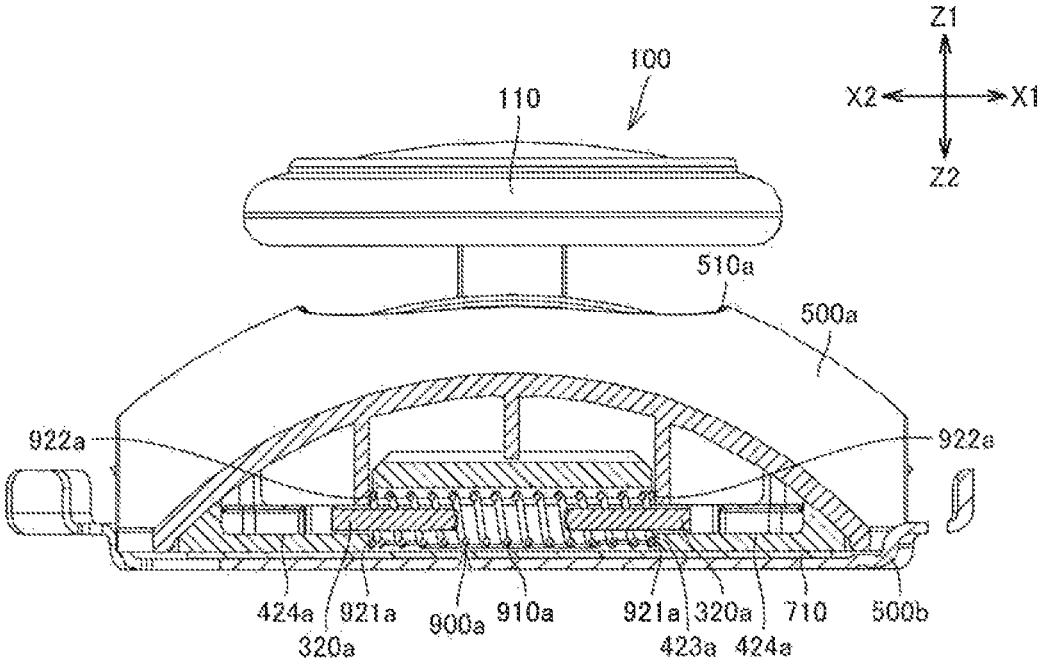
FIG. 2D is a cross-sectional view of the input device taken along line 2D-2D in FIG. 1A.

The first return mechanisms 900*a* elastically hold the respective first sliders 300*a* in the X1-X2 direction in order to maintain the operation lever 100 at the neutral position. As best illustrated in FIG. 2D, the first return mechanisms 900*a* each include a spring 910*a*, a pair of stops 921*a*, and a pair of stops 922*a*. The spring 910*a* is held by the pair of arms 320*a* of the associated first slider 300*a* and housed, together with the arms 320*a*, in the spring hole 423*a* of the associated first housing portion 420*a* of the body 400. One of the stops 921*a*, which is the X1-direction wall of the associated spring hole 423*a*, abuts the X1-direction end of the associated spring 910*a*. The other stop 921*a*, which is the X2-direction wall of the associated spring hole 423*a*, abuts the X2-direction end of the associated spring 910*a*. The stops 922*a* are protrusions on the cover 500*a*, provided in spaced relation in the X1-X2 direction. One of the stops 922*a* is received in the slit 424*a* on the X1-direction side of the associated first housing 420*a* of the body 400 and abuts the X1-direction end of the associated spring 910*a*. The other stop 922*a* is received in the slit 424*a* on the X2-direction side of the same first housing 420*a* and abuts the X2-direction end of the same spring 910*a*. Each spring 910*a* attached to the arms 320*a* of each first slider 300*a* is thus held by two sets of stops 921*a* and 922*a* and thereby elastically holds each first slider 300*a* in the X1-X2 direction.

When each first slider 300*a* moves in the X1 direction, each spring 910*a* is compressed between the arm 320*a* on the X2-direction side and the stops 921*a*, 922*a* on the X1-direction side. The compressed springs 910*a* exerts a biasing force to allow the first slider 300*a* to move in the X2 direction back to its original position. When each first slider 300*a* moves in the X2 direction, each spring 910*a* is compressed between the arm 320*a* on the X1-direction side and the stops 921*a*, 922*a* on the X2-direction side. The compressed springs 910*a* exerts a biasing force to allow the first slider 300*a* to move in the X1 direction back to its original position.

Figure 2E:
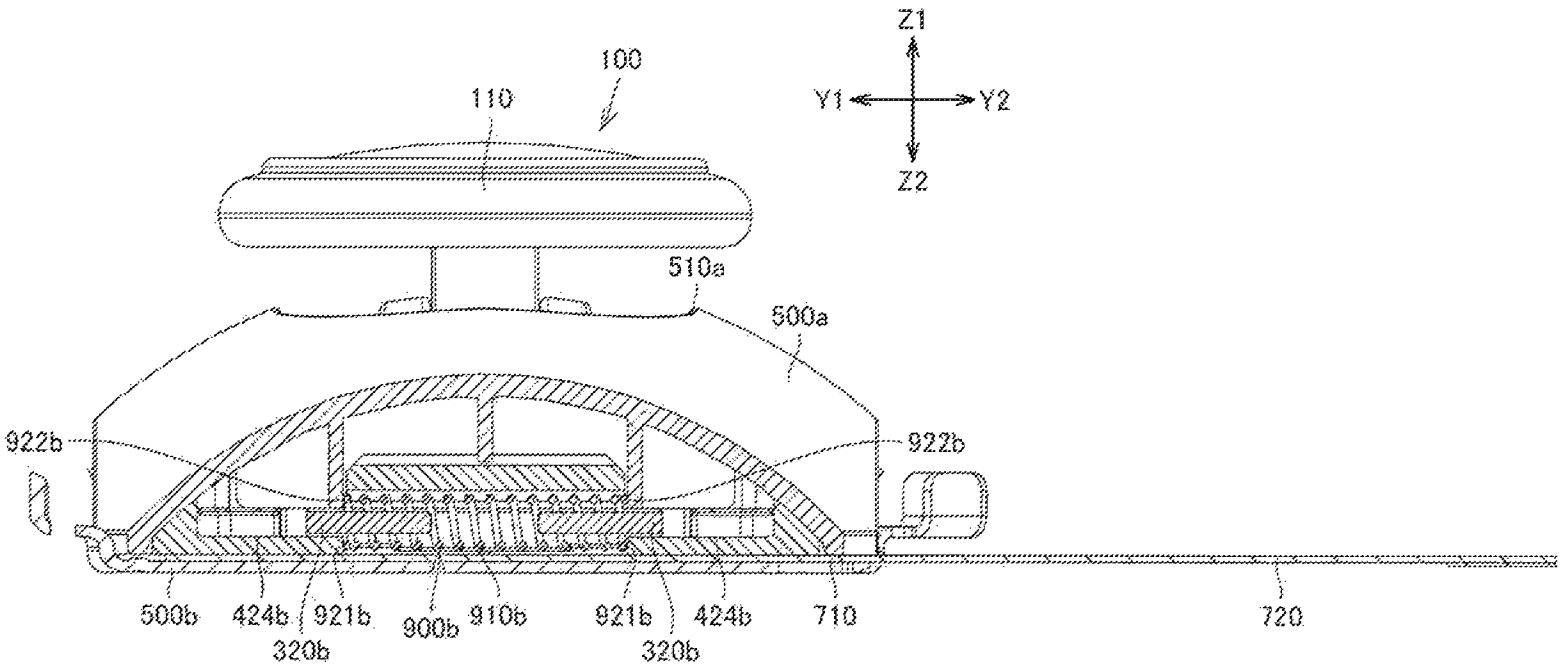
FIG. 2E is a cross-sectional view of the input device taken along line 2E-2E in FIG. 1A.

The second return mechanisms 900*b* elastically hold the respective second sliders 300*b* in the Y1-Y2 direction in order to maintain the operation lever 100 at the neutral position. As best illustrated in FIG. 2E, the second return mechanisms 900*b* each include a spring 910*b*, a pair of stops 921*b*, and a pair of stops 922*b*. The spring 910*b* is held by the pair of arms 320*b* of the associated second slider 300*b*. The spring 910*b* as compressed is housed, together with the arms 320*b*, in the spring hole 423*b* of the associated second housing portion 420*b* of the body 400. One of the stops 921*b*, which is the Y1-direction wall of the associated spring hole 423*b*, abuts the Y1-direction end of the associated spring 910*b*. The other stop 921*b*, which is the Y2-direction wall of the associated spring hole 423*b*, abuts the Y2-direction end of the associated spring 910*b*. The stops 922*b* are protrusions on the cover 500*a*, provided in spaced relation in the Y1-Y2 direction. One of the stops 922*b* is received in the slit 424*b* on the Y1-direction side of the associated second housing 420*b* of the body 400 and abuts the Y1-direction end of the associated spring 910*b*. The other stop 922*b* is received into the slit 424*b* on the Y2-direction side of the same second housing 420*b* and abuts the Y2-direction end of the same spring 910*b*. Each spring 910*b* attached to the arms 320*b* of each second slider 300*b* is thus held by two sets of stops 921*b* and 922*b* and thereby elastically holds each second slider 300*b* in the Y1-Y2 direction.

When each second slider 300*b* moves in the Y1 direction, each spring 910*b* is compressed between the arm 320*b* on the Y2-direction side and the stops 921*b*, 922*b* on the Y1-direction side. The compressed springs 910*b* exerts a biasing force to allow the second slider 300*b* to move in the Y2 direction back to its original position. When each second slider 300*b* moves in the Y2 direction, each spring 910*b* is compressed between the arm 320*b* on the Y1-direction side and the stops 921*b*, 922*b* on the Y2-direction side. The compressed springs 910*b* exerts a biasing force to allow the second slider 300*b* to move in the Y1 direction back to its original position.

The multidirectional input device configured as described above may be assembled in the following manner. First, the first interlocking member 200*a* and the body 400 are prepared. The guide projections 251*a*, 252*a* of the first interlocking member 200*a* are inserted into the respective spaces 433*a* of the first guides 430*a* of the body 400, and the guide projections 251*a*, 252*a* are brought into abutment with the lower faces of the ridges 432*a* of the first guides 430*a*. The second interlocking member 200*b* is also prepared. The guide projections 241*b*, 242*b* of the second interlocking member 200*b* are inserted into the respective spaces 433*b* of the second guides 430*b* of the body 400, and the guide projections 241*b*, 242*b* are brought into abutment with the lower faces of the ridges 432*b* of the second guides 430*b*. As a result, the second interlocking member 200*b* abuts on the support face 220*a* of the first interlocking member 200*a*, so that the first interlocking member 200*a* is disposed on top of and in substantially orthogonal orientation to the first interlocking member 200*a*.

The cover 500*a* is also prepared. The body 400 is inserted into the cover 500*a* and the engagement projections 470 of the body 400 are brought into engagement with the respective engagement holes 520*a* of the cover 500*a*. The body 400 is thus attached to the cover 500*a*.

Also prepared are the key top 110 and the slidable part 120 of the operation lever 100. The shaft 112 of the key top 110 is inserted from the opening 510*a* of the cover 500*a* into the elongated hole 210*b* of the second interlocking member 200*b* and the elongated hole 210*a* of the first interlocking member 200*a*. Then, the shaft 121 of the slidable part 120 is inserted into the elongated hole 210*a* of the first interlocking member 200*a* and is fixed to the shaft 112. The attachment member 130 is also prepared. The attachment member 130 is inserted through the through-hole 123 of the slidable part 120 and screwed with the attachment hole 112*a* of the shaft 112. Accordingly, the support 122 of the slidable part 120 abuts on the abuttable face 230*a* of the first interlocking member 200*a*, thereby preventing the operation lever 100 from dropping off in the Z1 direction.

Then, the mount 600 is housed inside the opening 410 of the body 400, while the guide projections 620 of the mount 600 are inserted into the respective guide holes 440 of the body 400. The mount 600 is thus arranged movably in the Z1-Z2 direction inside the opening 410 of the body 400, and the support face 610 of the mount 600 abuts on the slidable part 120 of the operation lever 100. As a result, the support 122 of the slidable part 120 is sandwiched between the support face 610 of the mount 600 and the abuttable face 230*a* of the first interlocking member 200*a*.

Also prepared are the first and second sliders 300*a*, 300*b* and the springs 910*a*, 910*b*. The contactor 810*a* of the first detector 800*a* is adhered onto the housing recess 311*a* of one of the first slider 300*a*, and the contactor 810*b* of the second detector 800*b* is adhered onto the housing recess 311*b* of one of the second slider 300*b*. The tips of the arms 320*a* of each of the first sliders 300*a* are inserted from the opposite sides thereof into each spring 910*a*. The tips of the arms 320*b* of each of the second sliders 300*b* are inserted from the opposite sides thereof into each spring 910*b*.

Then, the arms 320*a* of the first sliders 300*a* are inserted into the associated slits 424*a* of the first housing portion 420*a* of the body 400. Accordingly, the springs 910*a* are housed in the respective spring holes 423*a* of the first housing portions 420*a* and abuts on the stops 921*a*, 922*a*; the walls 330*a* of the first sliders 300*a* pass through the respective lower tracks 421*a* and then inserted into the respective upper tracks 422*a* and the spaces 433*a*; the projections 340*a* respectively pass through the lower tracks 421*a* and the upper tracks 422*a* of the first housing portions 420*a* and the spaces 433 so as to be engaged with the respective recesses 261*a* of the first interlocking member 200*a*. Consequently, the first sliders 300*a* and the springs 910*a* are housed in the associated first housing portions 420*a* of the body 400. Similarly, the second sliders 300*b* and the springs 910*b* are housed in the respective second housing portions 420*b* of the body 400.

The elastic member 900*c* is also prepared. An end of the elastic member 900*c* is inserted into the ring hole 640 of the mount 600. Also prepared are the circuit board 700, on which the movable contact 810*c* of the third detector 800*c* is fixed, and the frame 500*b*. The board body 710 of the circuit board 700 and the frame 500*b* are disposed on the body 400, so that the engagement pieces 510*b* of the frame 500*b* are engaged with the respective engagement holes 450 of the body 400, and that the engagement projections 460 of the body 400 are engaged with the engagement holes in the engagement pieces 520*b* of the frame 500*b*. Consequently, the elastic member 900*c* is interposed between the board body 710 and the mount 600 to support the mount 600 in midair; the protrusion 630 of the mount 600 is located above the apex of the movable contact 810*c* of the third detector 800*c*; and the contactors 810*a*, 810*b* of the first and second detectors 800*a*, 800*b* are in contact with the associated resistors and the associated conductors. The multidirectional input device is now completely assembled.

The assembled multidirectional input device may be used with each constituent operating in the following manner. When the operation lever 100 at the neutral position is operated in the X1 direction, the operation lever 100 slides on and along the support face 610 of the mount 600. During this slide, the shaft 112 of the operation lever 100 moves in the X1 direction within the elongated hole 210*b* of the second interlocking member 200*b*. On the other hand, the first interlocking member 200*a* is pressed in the X1 direction by the shafts 112, 121 of the operation lever 100 and thereby moves in the X1 direction in an arc-like manner along the support face 610. During this movement, the guide projections 251*a*, 252*a* of the first interlocking member 200*a* are respectively guided by the lower faces of the ridges 432*a* of the first guides 430*a* of the body 400, and the guide faces 241*a*, 242*a* of the first interlocking member 200*a* are respectively guided by the inner faces of the ridges 432*a* of the first guides 430*a*.

The movement in the X1 direction of the first interlocking member 200*a* causes their the engagement portions 260*a* to press the projections 340*a* of the first sliders 300*a* in the X1 direction. The first sliders 300*a* accordingly move in the X1 direction against the biasing forces of the springs 910*a*. Simultaneously, the projections 340*a* move in the Z1-Z2 direction relatively within the respective recesses 261*a* of the engagement portions 260*a*; and the contactor 810*a* of the first detector 800*a* slides on the resistor and the conductor so as to change the electrical resistance in the first detector 800*a*. In other words, the first detector 800*a* detects the direction and amount of movement of the associated first slider 300*a* as the direction and amount of movement of the first interlocking member 200*a*. The resistance change is forwarded through the connection portion 720 of the circuit board 700 out to e.g. a control part of an electronic device, which detects the resistance change as the direction and amount of movement of the operation lever 100. Each spring 910*a* is compressed between the X2-direction arm 320*a* of each first slider 300*a* and the X1-direction stops 921*a*, 922*a*.

When the operation lever 100 is released, the springs 910*a* bias the arms 320*a* on X2-direction side so as to move the first sliders 300*a* in the X2 direction back to their initial positions. The projections 340*a* of the first sliders 300*a* press the respective engagement portions 260*a* of the first interlocking member 200*a* in the X2 direction so as to move the first interlocking member 200*a* in the X2 direction back to its initial position. The first interlocking member 200*a* in turn presses the shafts 112, 121 of the operation lever 100 so as to move the operation lever 100 in the X2 direction back to the neutral position. It should be appreciated that when the operation lever 100 is operated in the X2 direction, the constituents of the multidirectional input device operate in a symmetrical manner to the operation in the X1 direction.

When the operation lever 100 at the neutral position is operated in the Y1 direction, the operation lever 100 slides on and along the support face 610 of the mount 600. During this slide, the shafts 112, 121 of the operation lever 100 move in the Y1 direction within the elongated hole 210*a* of the first interlocking member 200*a*. On the other hand, the second interlocking member 200*b* is pressed in the Y1 direction by the shaft 112 of the operation lever 100 and thereby moves in the Y1 direction in an arc-like manner along the support face 610. During this movement, the guide projections 241*b*, 242*b* of the second interlocking member 200*b* are respectively guided by the lower faces of the ridges 432*b* of the second guides 430*b* of the body 400, and the guide faces 231*b*, 232*b* of the second interlocking member 200*b* are respectively guided by the inner faces of the ridges 432*b* of the second guides 430*b*.

The movement in the Y1 direction of the second interlocking member 200*b* causes their engagement portions 250*b* to press the projections 340*b* of the second sliders 300*b* in the Y1 direction. The second sliders 300*b* accordingly move in the Y1 direction against the biasing forces of the springs 910*b*. Simultaneously, the projections 340*b* move in the Z1-Z2 direction relatively within the respective recesses 251*b* of the engagement portions 250*b*; and the contactor 810*b* of the second detector 800*b* slides on the resistors and the conductor so as to change the electrical resistance of the second detector 800*b*. In other words, the second detector 800*b* detects the direction and amount of movement of the associated second slider 300*b* as the direction and amount of movement of the second interlocking member 200*b*. The resistance change is forwarded through the connection portion 720 of the circuit board 700 out to e.g. a control part of an electronic device, which detects the resistance change as the direction and amount of movement of the operation lever 100. Each spring 910*b* is compressed between the Y2-direction arm 320*b* of each second slider 300*b* and the Y1-direction stops 921*b*, 922*b*.

When the operation lever 100 is released, the springs 910*b* bias the Y2-direction arms 320*b* so as to move the second sliders 300*b* in the Y2 direction back to their initial positions. The projections 340*b* of the second sliders 300*b* press the respective engagement portions 250*b* of the second interlocking member 200*b* in the Y2 direction so as to move the second interlocking member 200*b* in the Y2 direction back to its initial position. The second interlocking member 200*b* in turn presses the shaft 112 of the operation lever 100 so as to move the operation lever 100 in the Y2 direction back to the neutral position. It should be appreciated that when the operation lever 100 is operated in the Y2 direction, the constituents of the multidirectional input device operate in a symmetrical manner to the operation in the Y1 direction.

When the operation lever 100 at the neutral position is operated in a direction including an X1- and Y1-direction components, the constituents of the device operate in the same manner as when the operation lever 100 moves in the X1 direction and when it moves in the Y1 direction as described above. Resistance changes in the first and second detectors 800*a*, 800*b* are forwarded through the connection portion 720 of the circuit board 700 to a control part of an electronic device, which detects the received resistance changes as the direction and amount of movement of the operation lever 100.

When the operation lever 100 at the neutral position is operated in a direction including X1-direction and Y2-direction components, the constituents of the device operate in the same manner as when the operation lever 100 moves in the X1 direction and when it moves in the Y2 direction as described above. Resistance changes in the first and second detectors 800*a*, 800*b* are forwarded through the connection portion 720 of the circuit board 700 to a control part of an electronic device, which detects the received resistance changes as the direction and amount of movement of the operation lever 100.

When the operation lever 100 at the neutral position is operated in a direction including X2-direction and Y1-direction components, the constituents of the device operate in the same manner as when the operation lever 100 moves in the X2 direction and when it moves in the Y1 direction as described above. Resistance changes in the first and second detectors 800*a*, 800*b* are forwarded through the connection portion 720 of the circuit board 700 to a control part of an electronic device, which detects the received resistance changes as the direction and amount of movement of the operation lever 100.

When the operation lever 100 at the neutral position is operated in a direction including X2-direction and Y2-direction components, the constituents of the device operate in the same manner as when the operation lever 100 moves in the X2 direction and when it moves in the Y2 direction as described above. Resistance changes in the first and second detectors 800*a*, 800*b* are forwarded through the connection portion 720 of the circuit board 700 to a control part of an electronic device, which detects the received resistance changes as the direction and amount of movement of the operation lever 100.

When the operation lever 100 at the neutral position is pressed in the Z2 direction, the operation lever 100 presses the mount 600 in the Z2 direction. The pressed mount 600 moves in the Z2 direction against the biasing force of the elastic member 900*c*, and the first and second interlocking members 200*a*, 200*b* also move in the Z2 direction. Simultaneously, the projections 340*a* of the first sliders 300*a* move in the Z1 direction relatively within the respective recesses 261*a* of the first interlocking member 200*a*. The projections 340*b* of the second sliders 300*b* move relatively in the Z1 direction inside the respective recesses 251*b* of the second interlocking member 200*b*. The guide projections 251*a*, 252*a* of the first interlocking member 200*a* move away from the ridges 432*a* of the first guides 430*a* in the Z2 direction. The guide projections 241*b*, 242*b* of the second interlocking member 200*b* move away from the ridges 432*b* of the second guides 430*b* in the Z2 direction.

The movement in the Z2 direction of the mount 600 causes its protrusion 630 to depress the apex of the movable contact 810*c* of the third detector 800*c*. The depressed movable contact 810*c* elastically deforms and makes contact with the first stationary contact. This brings the first and second stationary contacts into conduction, allowing the third detector 800*c* to detect the operation in the Z2 direction of the operation lever 100.

The multidirectional input device described above has at least the following technical features. First, the device provides an improved operational feel of the operation lever 100 for the following reasons. The operation lever 100 slides on the generally spherically convexed support face 610 of the mount 600, so that the operation lever 100 can move along a longer route (rotate at a longer radius). Further, the protrusion 122*a* of the operation lever 100 slides on the support face 610 of the mount 600, reducing friction between the operation lever 100 and the support face 610.

Second, the multidirectional input device can detect operations of the operation lever 100 with improved accuracy for the following reasons. The first and second interlocking members 200*a*, 200*b* can move in an arc-like manner in accordance with movement of the operation lever 100, so that they each can move along a longer route (rotate at a longer radius). This advantage will not be impaired even when the multidirectional input device is downsized or thinned. Particularly, because of a shorter distance to the operable portion 111 of the operation lever 100, the first and second interlocking members 200*a*, 200*b* can move along a sufficiently long route (rotate at a sufficiently long radius). Therefore, the multidirectional input device is suitable for downsizing and thinning.

Third, the multidirectional input device has an advantageously small dimension in the Z1-Z2 direction for the following reasons. The second interlocking member 200*b* is placed on the support face 220*a* of the first interlocking member 200*a*, leaving no gap between the first interlocking member 200*a* and the second interlocking member 200*b*. Further, the springs 910*a*, 910*b* are oriented horizontally in the spring holes 423*a*, 423*b*.

Fourth, arc-like movements of the first and second interlocking members 200*a*, 200*b* will not apply load to the part connecting between the first interlocking member 200*a* and the first sliders 300*a* (i.e. to the recesses 261*a* and the projections 340*a*) or to the part connecting between the second interlocking member 200*b* and the second sliders 300*b* (i.e. to the recesses 251*b* and the projections 340*b*). This is because the recesses 261*a*, 251*b* extend in the Z1-Z2 direction, and the projections 340*a*, 340*b* are respectively engaged in the recesses 261*a*, 251*b* movably in the Z1-Z2 direction. Fifth, it is easy to couple the first sliders 300*a* to the first interlocking member 200*a* and the second sliders 300*b* to the second interlocking member 200*b*, only requiring engagement of the projections 340*a*, 340*b* with the recesses 261*a*, 251*b*, respectively.

Sixth, the first and second interlocking members 200*a*, 200*b* can move in a stable manner for the following reasons.

The guide projections 251*a*, 252*a* of the first interlocking member 200*a* are guided movably in the X1-X2 direction in an arc-like manner by the first guides 430*a* of the body 400, and the guide faces 241*a*, 242*a* of the first interlocking member 200*a* are also guided movably in the X1-X2 direction by the first guides 430*a*. Further, the guide projections 241*b*, 242*b* of the second interlocking member 200*b* are guided movably in the Y1-Y2 direction in an arc-like manner by the second guides 430*b* of the body 400, and the guide faces 231*b*, 232*b* of the second interlocking member 200*b* are also guided movably in the Y1-Y2 direction by the second guides 430*b*.

Seventh, the multidirectional input device can be fabricated with a reduced number of components for the following reasons. The first and second guides 430*a*, 430*b* of the body 400 regulate the movements of the first and second interlocking members 200*a*, 200*b*. The first and second housing portions 420*a*, 420*b* of the body 400 regulate the movements of the first and second sliders 300*a*, 300*b*. The opening 410 of the body 400 regulates the movement of the mount 600. Accordingly, these movement regulations are provided for in the multidirectional input device without adding separate components for this purpose.

The multidirectional input device of the invention is not limited to the configuration of the above embodiment but may be modified in any manner within the scope of the claims. Specific modification examples will be described in detail below.

The mount of the invention may be modified in any manner as long as it has a generally spherically convexed support face to support an operation lever slidably. For example, the mount may be provided on a circuit board or a body. The mount may also be integrated with the body.

The operation lever of the invention may be modified in any manner as long as it is slidably supported on the support face of the mount. The operation lever of the invention may be provided without the operable portion, the slidable part and/or the attachment member. The operable portion of the operation lever of the invention may be of any shape. The slidable part of the operation lever of the invention may be modified in any manner as long as it is placed slidably on the support face of the mount. For example, the slidable part may have a generally spherically concaved end face that is slidable on and along the support face of the mount. The slidable part may have an end face with a plurality of protrusions that are slidable on and along the support face of the mount. The support of the operation lever may be a separate component from the slidable part. The support may be provided on the shaft of the operation lever so as to be interposed between the first interlocking member and the mount. This modified support may be disposed in spaced relation to the mount. The attachment member of the operable portion of the invention may any member configured to attach the slidable part to the shaft. The attachment member may comprise a pin, an adhesive, a welding material, and/or a snap-fit mechanism.

The first interlocking member of the invention may be modified in any manner as long as it is configured to receive therethrough the operation lever of any of the above aspects and movable in a first direction in an arc-like manner in accordance with movement in the first direction of the operation lever. For example, the first interlocking member may be configured to receive therethrough the operation lever, be supported on the support face of the mount, and slidable in the first direction in an arc-like manner along the support face in accordance with the movement in the first direction of the operation lever. Alternatively, the first interlocking member may be configured to receive therethrough the operation lever, be supported on the first guide of the body moveably in the first direction in an arc-like manner in accordance with movement in the first direction of the operation lever. This modified first interlocking member may be disposed in spaced relation to the support face of the mount, or on the support face of the mount in a slidable manner. The first interlocking member of the invention may be provided without the support face, the abuttable face, the guide faces, the guide projections and/or the engagement portions. Any of the above modified first interlocking members may include a support face, an abuttable face, a guide face, a guide projection and/or an engagement portion.

The second interlocking member of the invention may be modified in any manner as long as it is configured to cross the first interlocking member of any of the above aspects, receive therethrough the operation lever of any of the above aspects, and be movable in a second direction in an arc-like manner in accordance with movement in the second direction of the operation lever. For example, the second interlocking member may be configured to cross the first interlocking member of any of the above aspects, receive therethrough the operation lever of any of the above aspects, and be slidable in the second direction in an arc-like manner on and along the support face of the first interlocking member in accordance with movement in the second direction of the operation lever. Alternatively, the second interlocking member may be configured to cross the first interlocking member of any of the above aspects, receive therethrough the operation lever of any of the above aspects, and be supported on the second guide of the body movably in the second direction in an arc-like manner in accordance with movement in the second direction of the operation lever. This modified second interlocking member may be disposed in spaced relation to the first interlocking member, or on the support face of the first interlocking member in a slidable manner. The second interlocking member may be provided without the abuttable face, the guide faces, the guide projections and/or the engagement portions. Any of the above modified second interlocking members may include a support face, an abuttable face, a guide face, a guide projection and/or an engagement portion.

At least one engagement portion of the first interlocking member of the invention may include a first projection extending in the second direction, and at least one engagement portion of the second interlocking member may include a second projection extending in the first direction. In this case, at least one first slider may have a first recess extending in a third direction that is substantially orthogonal to the first and second directions, and the first projection may be engaged in the first recess so as to be movable in the third direction. Also, at least one second slider may have a second recess extending in the third direction, and the second projection may be engaged in the second recess so as to be movable in the third direction. The recesses of the engagement portions of the first and second interlocking members of the first embodiment may be provided as bottomed recesses that do not pass through the engagement portions in the second direction and the first direction, respectively. The recesses may alternatively be recesses that are not open in the Z2 direction.

The first guide of the invention may be modified in any manner as long as it can guide the first interlocking member of any of the above aspects movably in the first direction in an arc-like manner. The second guide of the invention may be modified in any manner as long as it can guide the second interlocking member of any of the above aspects movably in the second direction in an arc-like manner. For example, the first and second guides may include ridges that can guide the upper faces of the first and second interlocking members movably in an arc-like manner. Alternatively, the first and second guides may include recesses or projections that can guide portions (e.g. guide projections) of the first and second interlocking members movably in an arc-like manner. The first and second guides of any of the above aspects may be provided on a member other than the body (the cover, for example).

The elastic body of the invention may be omitted. If provided, the elastic body may be modified in any manner as long as it can be interposed between the base and the mount to support the mount in midair. For example, the elastic body may be a rubber body or the movable contact of the third detector. If the operation lever is modified to one that cannot be depressed, the elastic body may be interposed between the base and the mount to support the mount in midair.

The multidirectional input device of the invention may be provided without the first and second sliders, or with at least one first slider and one second slider. The at least one first slider of the invention may be modified in any manner as long as it can move in the first direction in accordance with movement in the first direction of the first interlocking member of any of the above aspects. The at least one second slider of the invention may be modified in any manner as long as it can move in the second direction in accordance with movement in the second direction of the second interlocking member of any of the above aspects.

The first detector of the invention may be modified in any manner as long as it can detect directions and amounts of movements of the first interlocking member or the first slider of any of the above aspects. For example, the first detector may include a movable contact and a plurality of stationary contacts arranged at intervals in the first direction, and the movable contact may move in accordance with movement of the first interlocking member or the first slider to sequentially conduct at least two of the stationary contacts. The first detector may be an optical sensor that can optically detect directions and amounts of movements of the first interlocking member or the first slider, or may be a magnetic sensor that can magnetically detect directions and amounts of movements of the first interlocking member or the first slider.

The second detector of the invention may be modified in any manner as long as it can detect directions and amounts of movements of the second interlocking member or the second slider of any of the above aspects. The second detector may be modified in similar manners to the modifications to the first detector as described above.

The third detector of the invention may be omitted. The third detector of the invention may be modified in any manner as long as it can detect movements in the Z1-Z2 direction of the operation lever. For example, the third detector may be a switch, an optical sensor, or a magnetic sensor. The switch may be a tactile switch or a rubber switch, which can be turned on or off when depressed by the operation lever. The rubber switch may serve dual functions as the third detector and the elastic body. The optical sensor may be any sensor to optically detect movements in the Z1-Z2 direction of the operation lever or the mount. The magnetic sensor may be sensor to magnetically detect movements in the Z1-Z2 direction of the operation lever or the mount.

The first return mechanism of the invention may elastically hold the operation lever of any of the above aspects in the first direction. For example, the first return mechanism may include a first elastic body, interposed between the operation lever and a part of the body on one side in the first direction, and a second elastic body, interposed between the operation lever and a part of the body on the other side in the first direction. The first return mechanism of the invention may elastically hold the first interlocking member or the first slider of any of the above aspects in the first direction in order to maintain the operation lever of any of the above aspects at the neutral position. For example, the first return mechanism may include a first elastic body, interposed between the first interlocking member or the first slider and a part of the body on one side in the first direction, and a second elastic body, interposed between the first interlocking member or the first slider and a part of the body on the other side in the first direction.

The second return mechanism of the invention may elastically hold the operation lever of any of the above aspects in the second direction. For example, the second return mechanism may include a first elastic body, interposed between the operation lever and a part of the body on one side in the second direction, and a second elastic body, interposed between the operation lever and a part of the body on the other side in the second direction. The second return mechanism of the invention may elastically hold the second interlocking member or the second slider of any of the above aspects in the second direction in order to maintain the operation lever of any of the above aspects at the neutral position. For example, the second return mechanism may include a first elastic body, interposed between the second interlocking member or the second slider and a part of the body on one side in the second direction, and a second elastic body, interposed between the second interlocking member or the second slider and a part of the body on the other side in the second direction.

The multidirectional input device of the invention may further include a dust-proof film to cover the cover of any of the above aspects. The frame and/or the circuit board of the invention may be omitted.

It should be appreciated that the materials, shapes, dimensions, numbers, arrangements, and other configurations of the constituents of the multidirectional input device as described above may be modified in any manner if they can perform similar functions. The embodiments and modification examples may be combined with each other in any possible manner. The first direction of the invention may be any moving direction of the first interlocking member. The second direction of the invention may be any direction crossing the first direction. The third direction of the invention may be any direction orthogonal to the first direction and the second direction.

REFERENCE SIGNS LIST

100: operation lever
110: key top
120: slidable part
130: attachment member
200*a*: first interlocking member
210*a*: elongated hole
220*a*: support face
230*a*: abuttable face
241*a*, 242*a*: guide face
251*a*, 252*a*: guide projection
260*a*: engagement portion
261*a*: recess (first recess)
200*b*: second interlocking member

210*b*: elongated hole
220*b*: abuttable face
231*b*, 232*b*: guide face
241*b*, 242*b*: guide projection
250*b*: engagement portion
251*b*: recess (second recess)
300*a*: first slider
310*a*: slider body
320*a*: arm
330*a*: wall
340*a*: projection (first projection)
300*b*: second slider
310*b*: slider body
320*b*: arm
330*b*: wall
340*b*: projection (second projection)
400: body
410: opening
420*a*: first housing portion
420*b*: second housing portion
430*a*: first guide
430*b*: second guide
440: guide hole
450: engagement hole
460, 470: engagement projection
500*a*: cover
500*b*: frame
600: mount
700: circuit board
710: board body (base)
800*a*: first detector
800*b*: second detector
800*c*: third detector
900*a*: first return mechanism
900*b*: second return mechanism
900*c*: elastic body

The invention claimed is:

1. A multidirectional input device, comprising:

a mount, including a support face;

an operation lever;

a first interlocking member, receiving the operation lever therethrough and being movable in a first direction in an arc-like manner in accordance with movement in the first direction of the operation lever;

a second interlocking member, crossing the first interlocking member, receiving the operation lever therethrough, and being movable in a second direction in an arc-like manner in accordance with movement in the second direction of the operation lever, the second direction crossing the first direction;

a first detector configured to detect a direction and an amount of movement of the first interlocking member; and a second detector configured to detect a direction and an amount of movement of the second interlocking member, wherein the support face of the mount is of generally spherical convex shape projecting to one side in a third direction, the third direction being orthogonal to the first direction and the second direction, the operation lever is located on the one side in the third direction relative to the support face and is in direct contact with the support face so as to be slidably supported on the support face, and the first and second interlocking members are located on the one side in the third direction relative to the support face.

2. The multidirectional input device according to claim 1, wherein the operation lever includes a support disposed between the first interlocking member and the mount, the first interlocking member is supported on the support of the operation lever and movable in the first direction in an arc-like manner along the support face of the mount, the first interlocking member has a support face of arc shape extending in the second direction, and the second interlocking member is slidable in the second direction in an arc-like manner on and along the support face of the first interlocking member.

3. The multidirectional input device according to claim 1, wherein the first interlocking member is slidable in the first direction in an arc-like manner on and along the support face of the mount, the first interlocking member has a support face of arc shape extending in the second direction, and the second interlocking member is slidable in the second direction in an arc-like manner on and along the support face of the first interlocking member.

4. The multidirectional input device according to claim 1, wherein the second direction is substantially orthogonal to the first direction, the multidirectional input device further comprises:

a first slider movable in the first direction in accordance with movement of the first interlocking member, the first slider including a first projection extending in the second direction, and a second slider movable in the second direction in accordance with movement of the second interlocking member, the second slider including a second projection extending in the first direction, the first interlocking member includes a first recess extending in the third direction, the first projection of the first slider is engaged in the first recess movably in the third direction, the second interlocking member includes a second recess extending in the third direction, and the second projection of the second slider is engaged in the second recess movably in the third direction.

5. The multidirectional input device according to claim 2, wherein the second direction is substantially orthogonal to the first direction, the multidirectional input device further comprises:

a first slider movable in the first direction in accordance with movement of the first interlocking member, the first slider including a first projection extending in the second direction, and a second slider movable in the second direction in accordance with movement of the second interlocking member, the second slider including a second projection extending in the first direction, the first interlocking member includes a first recess extending in the third direction, the first projection of the first slider is engaged in the first recess movably in the third direction, the second interlocking member includes a second recess extending in the third direction, and the second projection of the second slider is engaged in the second recess movably in the third direction.

6. The multidirectional input device according to claim 3, wherein the second direction is substantially orthogonal to the first direction, the multidirectional input device further comprises:

a first slider movable in the first direction in accordance with movement of the first interlocking member, the first slider including a first projection extending in the second direction, and a second slider movable in the second direction in accordance with movement of the second interlocking member, the second slider including a second projection extending in the first direction, the first interlocking member includes a first recess extending in the third direction, the first projection of the first slider is engaged in the first recess movably in the third direction, the second interlocking member includes a second recess extending in the third direction, and the second projection of the second slider is engaged in the second recess movably in the third direction.

7. The multidirectional input device according to claim 1, wherein the second direction is substantially orthogonal to the first direction, the multidirectional input device farther comprises:

a first slider movable in the first direction in accordance with movement of the first interlocking member, the first slider including a first recess extending in the third direction, and a second slider movable in the second direction in accordance with movement of the second interlocking member, the second slider including a second recess extending in the third direction, the first interlocking member includes a first projection extending in the second direction, the first projection of the first interlocking member is engaged in the first recess movably in the third direction, the second interlocking member includes a second projection extending in the first direction, and the second projection of the second interlocking member is engaged in the second recess movably in the third direction.

8. The multidirectional input device according to claim 2, wherein the second direction is substantially orthogonal to the first direction, the multidirectional input device further comprises:

a first slider movable in the first direction in accordance with movement of the first interlocking member, the first slider including a first recess extending in the third direction, and a second slider movable in the second direction in accordance with movement of the second interlocking member, the second slider including a second recess extending in the third direction, the first interlocking member includes a first projection extending in the second direction, the first projection of the first interlocking member is engaged in the first recess movably in the third direction, the second interlocking member includes a second projection extending in the first direction, and the second projection of the second interlocking member is engaged in the second recess movably in the third direction.

9. The multidirectional input device according to claim 3, wherein the second direction is substantially orthogonal to the first direction, the multidirectional input device further comprises:

a first slider movable in the first direction in accordance with movement of the first interlocking member, the first slider including a first recess extending in the third direction, and a second slider movable in the second direction in accordance with movement of the second interlocking member, the second slider including a second recess extending in the third direction, the first interlocking member includes a first projection extending m the second direction, the first projection of the first interlocking member is engaged in the first recess movably in the third direction, the second interlocking member includes a second projection extending in the first direction, and the second projection of the second interlocking member is engaged in the second recess movably in the third direction.

10. The multidirectional input device according to claim 1, further comprising:

a first guide configured to guide the first interlocking member movably in the first direction in an arc-like manner, and a second guide configured to guide the second interlocking member movably in the second direction in an arc-like manner.

11. A multidirectional input device comprising:

a mount, including a support face of generally spherical convex shape;

an operation lever slidably supported on the support face;

a first interlocking member, configured to receive the operation lever therethrough and be movable in a first direction in an arc-like manner in accordance with movement in the first direction of the operation lever;

a second interlocking member, configured to cross the first interlocking member, receive the operation lever therethrough, and be movable in a second direction in an arc-like manner in accordance with movement in the second direction of the operation lever, the second direction being substantially orthogonal to the first direction;

a first detector configured to detect a direction and an amount of movement of the first interlocking member;

a second detector configured to detect a direction and an amount of movement of the second interlocking member;

a first slider movable in the first direction in accordance with movement of the first interlocking member;

a second slider movable in the second direction in accordance with movement of the second interlocking member; and a body, the body including:

a first housing portion to house the first slider movably in the first direction;

a second housing portion to house the second slider movably in the second direction;

a first guide at one side of a third direction relative to the first housing portion, the first guide being configured to guide the first interlocking member to move in the first direction in an arc-like manner, the third direction being substantially orthogonal to the first direction and the second direction; and a second guide at the one side of the third direction relative to the second housing portion, the second guide being configured to guide the second interlocking member to move in the second direction in an arc-like manner, wherein the first slider includes a first projection extending in the second direction and the first interlocking member includes a first recess extending in the third direction, or alternatively the first interlocking member includes the first projection and the first slider includes the first recess, the first projection is engaged in the first recess movably in the third direction, the second slider includes a second projection extending in the first direction and the second interlocking member includes a second recess extending in the third direction, or alternatively the second interlocking member includes the second projection and the second slider includes the second recess, and the second projection is engaged in the second recess movably in the third direction.

12. The multidirectional input device according to claim 1, further comprising;

a base; and an elastic body interposed between the base and the mount, the elastic body supporting the mount in midair.

13. The multidirectional input device according to claim 2, further comprising:

a base; and an elastic body interposed between the base and the mount, the elastic body supporting the mount in midair.

14. The multidirectional input device according to claim 3, further comprising:

a base; and an elastic body interposed between the base and the mount, the elastic body supporting the mount in midair.

15. The multidirectional input device according to claim 2, further comprising:

a base; and an elastic body interposed between the base and the mount, the elastic body supporting the mount in midair and providing a biasing force to hold the support of the operation lever between the mount and the first interlocking member.

16. A multidirectional input device, comprising:

a mount, including a support face of generally spherical convex shape;

an operation lever slidably supported on the support face;

a first interlocking member, configured to receive the operation lever therethrough and be movable in a first direction in an arc-like manner in accordance with movement in the first direction of the operation lever;

a second interlocking member, configured to cross the first interlocking member, receive the operation lever therethrough, and be movable in a second direction in an arc-like manner in accordance with movement in the second direction of the operation lever, the second direction crossing the first direction;

a first detector configured to detect a direction and an amount of movement of the first interlocking member;

a second detector configured to detect a direction and an amount of movement of the second interlocking member;

a base; and an elastic body interposed between the base and the mount, the elastic body supporting the mount in midair, wherein the operation lever is movable in a third direction so as to depress the mount, the third direction being substantially orthogonal to the first direction and the second direction, the mount as depressed is movable against an elastic force of the elastic body, and the multidirectional input device further comprises a third detector configured to detect the movement of the operation lever.

17. The multidirectional input device according to claim 15, wherein the operation lever is movable in the third direction so as to depress the mount, the mount as depressed is movable against an elastic force of the elastic body, and the multidirectional input device further comprises a third detector configured to detect the movement of the operation lever.

18. The multidirectional input device according to claim 4, wherein the first detector is configured to detect a direction and an amount of movement of the first interlocking member by detecting a direction and an amount of movement of the first slider, and the second detector configured to detect a moving direction and a moving amount of movement of the second interlocking member by detecting a moving direction and a moving amount of movement of the second slider.

19. The multidirectional input device according to claim 7, wherein the first detector is configured to detect a direction and an amount of movement of the first interlocking member by detecting a direction and an amount of movement of the first slider, and the second detector configured to detect a moving direction and a moving amount of movement of the second interlocking member by detecting a moving direction and a moving amount of movement of the second slider.

20. The multidirectional input device according to claim 11, wherein the first detector is configured to detect a direction and an amount of movement of the first interlocking member by detecting a direction and an amount of movement of the first slider, and the second detector configured to detect a moving direction and a moving amount of movement of the second interlocking member by detecting a moving direction and a moving amount of movement of the second slider.

* * * * *